US006902350B2

(12) United States Patent
Orthaus et al.

(10) Patent No.: US 6,902,350 B2
(45) Date of Patent: Jun. 7, 2005

(54) COLLATED ROAD MARKER ASSEMBLY, AND SYSTEM AND METHOD FOR AUTOMATICALLY APPLYING COLLATED ROAD MARKERS TO ROADWAY SURFACES

(75) Inventors: Chad M. Orthaus, Alexandria, MN (US); Calice G. Courneya, Alexandria, MN (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/823,744

(22) Filed: Apr. 14, 2004

(65) Prior Publication Data

US 2004/0197143 A1 Oct. 7, 2004

Related U.S. Application Data

(60) Division of application No. 10/422,828, filed on Apr. 25, 2003, which is a continuation-in-part of application No. 10/302,994, filed on Nov. 25, 2002.

(51) Int. Cl.[7] ..... E01C 5/00
(52) U.S. Cl. ..... 404/73
(58) Field of Search ..... 404/9, 10, 12, 404/15, 16, 72, 73, 93, 94; 221/1

(56) References Cited

U.S. PATENT DOCUMENTS

| | | | | |
|---|---|---|---|---|
| 1,766,073 | A | 6/1930 | Hartzler et al. | |
| 1,833,124 | A | 11/1931 | Rand | |
| 3,380,428 | A | 4/1968 | Abrams | |
| 3,399,607 | A | 9/1968 | Eigenmann | |
| 3,963,362 | A | 6/1976 | Hollis | |
| 4,111,581 | A | 9/1978 | Auriemma | |
| 4,136,991 | A | 1/1979 | Clark et al. | |
| 4,445,803 | A | 5/1984 | Dixon | |
| 4,521,129 | A | 6/1985 | Krech et al. | |
| 4,534,673 | A | 8/1985 | May | |
| 4,542,709 | A | 9/1985 | Spaugh | |
| 4,645,168 | A | 2/1987 | Beard | |
| 4,792,259 | A | 12/1988 | Eigenmann | |
| 4,895,428 | A | 1/1990 | Nelson et al. | |
| 4,991,994 | A | 2/1991 | Edouart | |
| 5,327,850 | A | 7/1994 | Sly et al. | |
| 5,391,015 | A | 2/1995 | Kaczmarczik et al. | |
| 5,392,728 | A | 2/1995 | Speer et al. | |
| 5,393,166 | A | 2/1995 | Stock et al. | |
| 5,460,115 | A | 10/1995 | Speer et al. | |
| 5,515,807 | A | 5/1996 | Speer et al. | |
| 5,788,405 | A | 8/1998 | Beard | |
| 5,853,263 | A | 12/1998 | Green | |
| 5,853,846 | A | 12/1998 | Clark et al. | |
| 5,906,701 | A | 5/1999 | Smythe | |
| 5,934,822 | A | 8/1999 | Green | |
| 6,109,820 | A | 8/2000 | Hughes, Sr. | |
| 6,709,193 | B1 * | 3/2004 | Rogers et al. | 404/94 |
| 6,712,548 | B1 * | 3/2004 | Rogers et al. | 404/72 |
| 6,752,568 | B1 * | 6/2004 | Stone | 404/99 |

FOREIGN PATENT DOCUMENTS

| | | |
|---|---|---|
| WO | WO95/2731 | 1/1995 |

* cited by examiner

*Primary Examiner*—Gary S. Hartmann
(74) *Attorney, Agent, or Firm*—Schwartz & Weinrieb

(57) ABSTRACT

A collated array of temporary raised pavement markers (TRPMs), or permanent half-track and full-track raised pavement markers (RPM), has the pavement markers disposed in a nested arrangement with portions of a release sheet folded between successive ones of the pavement markers such that when the folded portions of the release sheet are unfolded in conjunction with the dispensing of a leading one of the pavement markers, feather-edge boundary structure defined between the release sheet and the block of adhesive material upon the associated one of the pavement markers is effectively recombined with the primary mass of adhesive material upon the pavement marker such that the feather-edge structure is assimilated into the primary mass of adhesive material in order to readily permit the separation, peeling, and stripping of the release sheet from the pavement marker.

18 Claims, 8 Drawing Sheets

226
226
211
211
210
212
234
211
W
220
212
218
218
216
214
216
214
LL 211-2
211-3
214
236
212
212
242
214
240
246
238
A
220
242
240
I
248
244
B
212
218
LL

COLLATED ROAD MARKER ASSEMBLY, AND SYSTEM AND METHOD FOR AUTOMATICALLY APPLYING COLLATED ROAD MARKERS TO ROADWAY SURFACES

CROSS-REFERENCE TO RELATED PATENT APPLICATIONS

This patent application is a Divisional patent application of prior U.S. patent application Ser. No. 10/422,828, which was filed on Apr. 25, 2002.

This patent application is a Continuation-in-Part (CIP) of United States Patent Application which was entitled COLLATED ROAD MARKER ASSEMBLY, AND SYSTEM AND METHOD FOR AUTOMATICALLY APPLYING COLLATED ROAD MARKERS TO ROADWAY SURFACES, which was filed on Nov. 25, 2002, and which has been assigned Ser. No. 10/302,994.

FIELD OF THE INVENTION

The present invention relates generally to temporary raised pavement markers (TRPMs) and permanent raised pavement markers (RPMs) which are adapted to be fixedly secured to roadway surfaces in order to, for example, temporarily define traffic lanes or the like within construction zones, work sites, or maintenance or repair areas, or to permanently define traffic lanes upon roadway or highway surfaces, and more particularly to a new and improved collated assembly of such temporary raised pavement markers (TRPMs) and permanent raised pavement markers (RPMs), and a new and improved system and method for automatically serially applying such collated temporary raised pavement markers (TRPMs) and permanent raised pavement markers (RPMs) to roadway surfaces in order to in fact temporarily define the traffic lanes or the like within the construction zones, work sites, or maintenance or repair areas, or to permanently define traffic lanes upon roadway or highway surfaces.

BACKGROUND OF THE INVENTION

Various types of roadway markers have been utilized in connection with a variety of traffic control applications. Many roadway markers are adapted to be permanently attached or secured to the road surface so as to permanently delineate traffic lanes upon the roadway, while other roadway markers are adapted to be temporarily attached or secured to particular road surfaces in order to temporarily delineate traffic lanes within construction zones or other work areas. Accordingly, the latter type of roadway markers are known as temporary roadway markers and are usually attached or secured to the road surface by means of a suitable adhesive that can retain the roadway marker in its place upon the road surface during the temporary life of the roadway marker. More particularly, temporary roadway markers can serve, for example, as a means for identifying edge portions of the roadway, or alternatively, to delineate traffic lane lines and thereby demarcate separate lanes of traffic from each other in and around construction sites and other work zones. After the construction or other road work is completed, the temporary roadway markers are removed. To be effective, the temporary roadway markers must clearly be capable of alerting motorists to the fact that they are nearing or entering a construction zone or work area, and therefore, the temporary roadway markers must in fact be effective both during daytime hours, nighttime hours, sunny conditions, cloudy conditions, inclement weather conditions, and the like. More particularly, one type of temporary roadway marker that has been extremely successful or effective in providing short-term temporary markings upon roadways both during daytime and nighttime hours, and which has also been able to adequately withstand the various impact forces that are normally impressed thereon by daily roadway vehicular traffic so as to in fact provide the desired service life required in connection with the installation of such temporary roadway markers, has been that type of temporary roadway marker which is known in the industry as a temporary raised pavement marker (TRPM). Examples of such temporary raised pavement markers (TRPMs) are disclosed within U.S. Pat. No. 6,109,820 which issued to Hughes, Sr. on Aug. 29, 2000, U.S. Pat. No. 5,788,405 which issued to Beard on Aug. 4, 1998, U.S. Pat. No. 5,460,115 which issued to Speer et al. on Oct. 24, 1995, U.S. Pat. No. 4,991,994 which issued to Edouart on Feb. 12, 1991, and U.S. Pat. No. 4,445,803 which issued to Dixon on May 1, 1984.

As can readily be appreciated from FIG. 1, which corresponds substantially to FIG. 1 of the Speer et al. patent, it is briefly noted that an exemplary temporary raised pavement marker (TRPM) 10 is seen to have a substantially L-shaped configuration wherein the horizontally disposed leg portion 12 thereof is adapted to be fixedly secured or attached to the road surface by means of a suitable adhesive which is allowed to set, while the vertically upstanding leg portion 14 is adapted to be visually seen by the oncoming motorist. A transition region 26 flexibly interconnects the vertically upstanding leg portion 14 to the fixed horizontally disposed leg portion or base member 12. A pair of rib members or ledges 28,28 extend substantially perpendicular to the upstanding leg member 14 and serve to define a space or channel 22 therebetween. A suitable reflective strip 23 is adapted to be fixedly disposed within the space or channel 22 so as to reflect sunlight or a vehicle's lights in order to provide the oncoming motorist, as indicated by the arrow 25, with a visual indication of a traffic lane, or alternatively, that the motorist is entering or approaching a construction zone or work area. Alternatively, in lieu of the reflective strip 23, the entire marker 10 may simply be brightly colored so as to similarly provide the oncoming motorist with the necessary visual warning.

With reference being further made to FIG. 2, a typical, conventional, PRIOR ART temporary raised pavement marker (TRPM), which is similar to the temporary raised pavement marker (TRPM) 10 disclosed in FIG. 1 of the present drawings as well as within FIG. 1 of the Speer et al. patent, is disclosed at 110 and is seen to likewise have a substantially L-shaped configuration. In particular, the temporary raised pavement marker (TRPM) 110 comprises a horizontally disposed leg or base member 112, and a vertically upstanding leg member 114 integrally connected to the horizontally disposed leg or base member 112 by means of a transitional region 116. A block or slab of adhesive 118 is fixedly secured to an undersurface or lower face portion of the horizontally disposed leg or base member 112, and in turn, a release sheet 120 is secured to an undersurface or lower face portion of the adhesive slab 118 so as to prevent the adhesive slab 118 from being inadvertently adhesively bonded to any surface, other than that particular location or portion of the roadway to which the temporary raised pavement marker (TRPM) 110 is to be fixedly secured, prior to the actual fixation of the temporary raised pavement marker (TRPM) 110 upon a selected location or portion of the roadway. As was the case with the temporary raised pavement marker (TRPM) 10 of FIG. 1 of the present drawings as well as those of Speer et al., the upper end portion of the vertically upstanding leg member 114 of the temporary raised pavement marker (TRPM) 110 also comprises a pair of horizontally disposed rib members 122,122 which define a space or channel 124 therebetween for housing or accommodating a suitable reflector strip, not shown. Alternatively, the entire extrusion comprising the temporary raised pavement marker (TRPM) 110 may be fabricated from a suitable plastic material which is brightly colored, that is, it may be fabricated from a suitable resin material which is white or yellow.

The temporary raised pavement markers (TRPMs) 110 are normally placed upon the roadway surface during an extended period of time that construction or other road work is being performed upon the roadway surface, and therefore, the temporary raised pavement markers (TRPMs) 110 are normally placed upon the roadway surface prior to the completion of the entire construction or other road work as well as the application of the permanent traffic lane lines to the roadway surface. Accordingly, in order to protect the reflector strip, not shown, which is adapted to be disposed, housed, or accommodated within the space or channel 124 defined between the pair of horizontally disposed rib members 122,122, or alternatively, in order to protect the upper portion of the vertically upstanding leg member 114, when such portion of the temporary raised pavement marker (TRPM) 110 is to be used as the visual warning to oncoming motorists, from road paving materials, debris, and the like, a protective cover 126, fabricated from a suitable clear plastic material and having a substantially inverted U-shaped configuration, is disposed over the upper free edge portion of the temporary raised pavement marker (TRPM) 110.

When the temporary raised pavement markers (TRPMs) 110 are to be subsequently used in conjunction with, for example, their traffic lane delineation functions, the protective covers 126 are removed, and still further, when the need for the temporary raised pavement markers (TRPMs) 110 is no longer required in view of the completion of the construction or other roadwork, the temporary raised pavement markers (TRPMs) 110 themselves will obviously be removed from the roadway surface, and the permanent raised pavement markers (RPMs) will be applied to the roadway surface. Examples of permanent raised pavement markers (RPMs) are disclosed within U.S. Pat. No. 5,515,807 which issued to Speer et al. on May 14, 1996, U.S. Pat. No. 5,392,728 which issued to Speer et al. on Feb. 28, 1995, U.S. Pat. No. 5,327,850 which issued to Speer et al. on Jul. 12, 1994, and U.S. Pat. No. 4,895,428 which issued to Nelson et al. on Jan. 23, 1990. Until now, the process for mounting and securing both the temporary raised pavement markers (TRPMs) and the permanent raised pavement markers (RPMs) upon the roadway surfaces has been accomplished manually whereby construction workmen or other personnel would have to manually deposit the temporary raised pavement markers (TRPMs) onto the roadway surface as a result of, for example, removing the release sheet from the undersurface portion of the adhesive slab or layer and pressing the temporary raised pavement marker (TRPM) or permanent raised pavement marker (RPM) onto the roadway surface so as to cause the adhesive bonding of the temporary raised pavement marker (TRPM) or the permanent raised pavement marker (RPM) to the roadway surface. In view of the fact that the construction workmen or other personnel are physically present upon the particular roadway surface during the performance of such temporary raised pavement marker (TRPM) or permanent raised pavement marker (RPM) application operations onto the roadway surface, the workmen or personnel are undesirably exposed to dangerous vehicular conditions present upon the roadway. In addition, the temporary raised pavement marker (TRPM) and permanent raised pavement marker (RPM) application procedures are quite tedious, time-consuming, and problematic.

More particularly, it is noted that in connection with one conventional technique for currently fabricating temporary raised pavement markers (TRPMs), the temporary raised pavement markers (TRPMs) are initially manufactured as elongated structures having the aforenoted substantially L-shaped cross-sectional configuration, and the adhesive material and release liner components are then applied to the undersurface portions of the relatively short, normally horizontally disposed leg members thereof. Subsequently, the elongated structures are cut at predetermined locations thereof so as to provide finalized temporary raised pavement markers (TRPMs) having predetermined width dimensions. As can therefore be readily appreciated, however, as a result of such cutting or severing operations, the adhesive material and release liner components, as disposed upon the finalized temporary raised pavement markers (TRPMs), will have the same lateral extents, and therefore, the end portions of the release liner do not project laterally beyond the end portions of the adhesive material. Accordingly, the end portions of the adhesive material are effectively uncovered and exposed which presents problems in connection with the mechanical feeding of the temporary raised pavement markers (TRPMs) within automated machinery, as well as in connection with the packaging of the temporary raised pavement markers (TRPMs). Still further, it is to be noted and appreciated that when the adhesive material is applied to or deposited upon the undersurface portion of the relatively short leg of the elongated temporary raised pavement marker (TRPM) structure, the adhesive is applied or deposited in a heated state.

Subsequently, the adhesive material will cool, and as a result of the cooling process, the adhesive material undergoes a predetermined amount of shrinkage or contraction. Such shrinkage or contraction effectively forms a bond between the primary mass of the adhesive material and the release liner which effectively defines a line of demarcation or boundary which is known as a feather-edge bond. The feather-edge bond is very flexible and tends to bend along with the release liner. Accordingly, when it is attempted to remove the release liner from the adhesive material, in preparation for the application of each one of the temporary raised pavement markers (TRPMs) to the pavement surface, the feather-edge bond structure is placed in tension, and it has been noted that the tensile strength characteristics of the feather-edge bond structure are greater than the force levels normally required to peel the release liner from the adhesive material as well as the tensile or shear strength characteristics of the release liner per se. It can therefore be appreciated further that when the release liner is desired to be removed from its associated temporary raised pavement marker (TRPM), not only is such an operation difficult to achieve, but it often happens that the release liner and/or the adhesive material disposed upon the undersurface portion of the temporary raised pavement marker (TRPM) is damaged which can render the use of the particular temporary raised pavement marker (TRPM) unsuitable. Similar problems or operational difficulties are likewise characteristic of the manufacture and subsequent use of the permanent raised pavement markers (RPMs).

A need therefore exists in the art for a new and improved collated assembly of such temporary raised pavement markers (TRPMs) and permanent raised pavement markers (RPMs) which will enable the new and improved collated assembly of temporary raised pavement markers (TRPMs) and permanent raised pavement markers (RPMs) to be automatically applied to roadway surfaces by means of a new and improved system and method wherein the aforenoted operational drawbacks and disadvantages, characteristic of conventional or PRIOR ART temporary raised pavement markers (TRPMs) and permanent raised pavement markers (RPMs), and the methods and techniques for applying such conventional or PRIOR ART temporary raised pavement markers (TRPMs) and permanent raised pavement markers (RPMs) to roadway surfaces, are effectively overcome.

OBJECTS OF THE INVENTION

Accordingly, it is an object of the present invention to provide a new and improved collated assembly of temporary raised pavement markers (TRPMs) and permanent raised pavement markers (RPMs), and a new and improved system and method for automatically serially applying such collated temporary raised pavement markers (TRPMs) and permanent raised pavement markers (RPMs) to roadway surfaces.

Another object of the present invention is to provide a new and improved collated assembly of temporary raised pavement markers (TRPMs) and permanent raised pavement markers (RPMs), and a new and improved system and method for automatically serially applying such collated temporary raised pavement markers (TRPMs) and permanent raised pavement markers (RPMs) to roadway surfaces, which effectively overcome the various structural and operational drawbacks and disadvantages characteristic of PRIOR ART temporary raised pavement markers (TRPMs) and permanent raised pavement markers (RPMs), as well as the methods and techniques for applying such temporary raised pavement markers (TRPMs) and permanent raised pavement markers (RPMs) to roadway surfaces.

An additional object of the present invention is to provide a new and improved collated assembly of temporary raised pavement markers (TRPMs) and permanent raised pavement markers (RPMs) which will readily facilitate the separation of each one of the temporary raised pavement markers (TRPMs) and permanent raised pavement markers (RPMs) from its release liner so that the temporary raised pavement markers (TRPMs) and permanent raised pavement markers (RPMs) can be readily and easily applied to roadway surfaces.

A further object of the present invention is to provide a new and improved collated assembly of temporary raised pavement markers (TRPMs) and permanent raised pavement markers (RPMs) which will readily facilitate the separation of each one of the temporary raised pavement markers (TRPMs) and permanent raised pavement markers (RPMs) from its release liner so that the temporary raised pavement markers (TRPMs) and permanent raised pavement markers (RPMs) can be readily, easily, and automatically applied in a serial manner to roadway surfaces by means of the new and improved system and method of the present invention.

A last object of the present invention is to provide a new and improved collated assembly of temporary raised pavement markers (TRPMs) and permanent raised pavement markers (RPMs) which will readily facilitate the separation of each one of the temporary raised pavement markers (TRPMs) and permanent raised pavement markers (RPMs) from its release liner so that the temporary raised pavement markers (TRPMs) and permanent raised pavement markers (RPMs) can be readily, easily, and automatically applied in a serial manner to roadway surfaces by means of the new and improved system and method of the present invention whereby operator personnel are not exposed to the hazards and dangers inherently characteristic of manual temporary raised pavement marker (TRPM) and permanent raised pavement marker (RPM) application techniques and methods.

SUMMARY OF THE INVENTION

The foregoing and other objectives are achieved in accordance with the teachings and principles of the present invention through the provision of a new and improved collated assembly of temporary raised pavement markers (TRPMs) and permanent raised pavement markers (RPMs) wherein each one of the plurality of temporary raised pavement markers (TRPMs) and permanent raised pavement markers (RPMs) has the undersurface portion of its adhesive material block mounted upon a single elongated release liner or release sheet such that the plurality of temporary raised pavement markers (TRPMs) and permanent raised pavement markers (RPMs) are longitudinally separated from each other by means of predetermined spaces. Subsequently, the plurality of temporary raised pavement markers (TRPMs) and permanent raised pavement markers (RPMs) are disposed in an overlapped or nested mode or state, and in accordance with a unique and novel feature characteristic of the present invention, the single elongated release liner or release sheet is disposed in a substantially fan-folded manner between each one of the temporary raised pavement markers (TRPMs) and permanent raised pavement markers (RPMs) such that, as considered in the longitudinal direction of the release sheet or release liner, a portion of the fan-folded release sheet or release liner is disposed longitudinally inwardly from or forwardly of the longitudinal rear edge portion of the adhesive material block of the temporary raised pavement marker (TRPM) or permanent raised pavement marker (RPM) as considered in the direction of movement of the automatic apparatus for applying or depositing the temporary raised pavement markers (TRPMs) and permanent raised pavement markers (RPMs) onto or upon the roadway surface.

Accordingly, it can be appreciated further that the aforenoted feather-edge bond boundary, defined upon each temporary raised pavement marker (TRPM) or each permanent raised pavement marker (RPM) between the release sheet or release liner, and the adhesive material block, is disposed at a longitudinal position which is located longitudinally inwardly from or forwardly of the longitudinal rear edge portion of the adhesive material block of the temporary raised pavement marker (TRPM) or permanent raised pavement marker (RPM). Consequently, when the particular temporary raised pavement marker (TRPM) or permanent raised pavement marker (RPM) is to be applied to or deposited upon the roadway surface, the fan-folded portion of the release sheet or release liner, as disposed beneath the temporary raised pavement marker (TRPM) or permanent raised pavement marker (RPM), will now be unfolded whereby the aforenoted feather-edge bond boundary, defined upon the temporary raised pavement marker (TRPM) or permanent raised pavement marker (RPM) between the release sheet or release liner, and the adhesive material block, will effectively be re-combined with and integrally incorporated within the primary adhesive material block. Due to the greater affinity characteristics of the feather-edge bond with respect to the adhesive material block, as opposed to the affinity characteristics of the feather-edge bond with respect to the release sheet or release liner, the existence of the feather-edge bond has been effectively eliminated along with the operational difficulties of separating or peeling the release liner or release sheet from the adhesive material block. Thus, the temporary raised pavement markers (TRPMs) or permanent raised pavement markers (RPMs) can be readily and easily serially separated from the single release liner or release sheet and accordingly applied to or deposited upon the roadway surface.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 2:
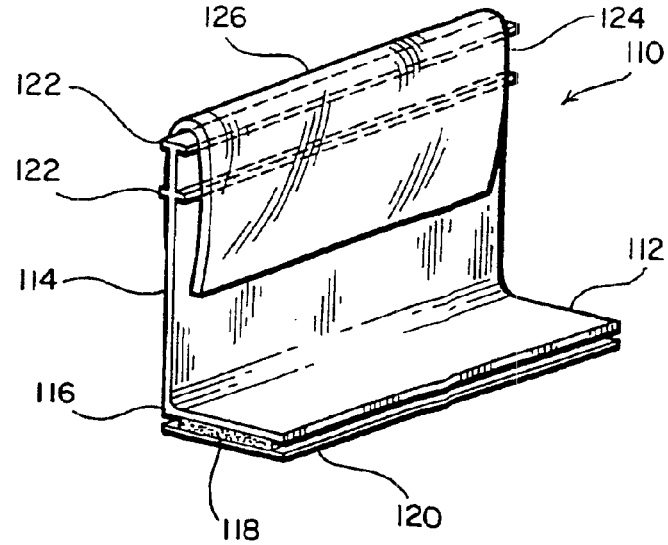
FIG. 2 (PRIOR ART)
FIG. 2 is a perspective view of a second PRIOR ART temporary raised pavement marker (TRPM)
Figure 3:
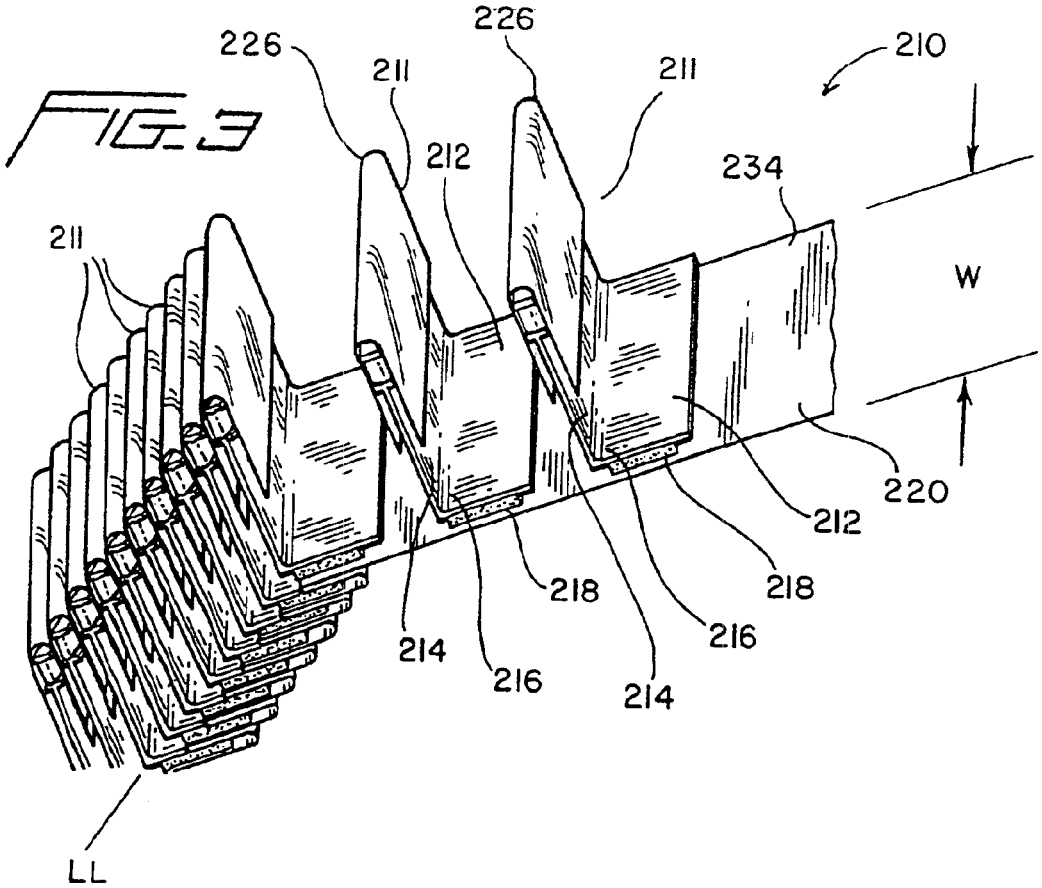
FIG. 3 is a perspective view of a plurality of temporary raised pavement markers (TRPMs) showing the same being arranged within their nested or collated state or array in accordance with the unique and novel teachings and principles of the present invention.
Figure 4:
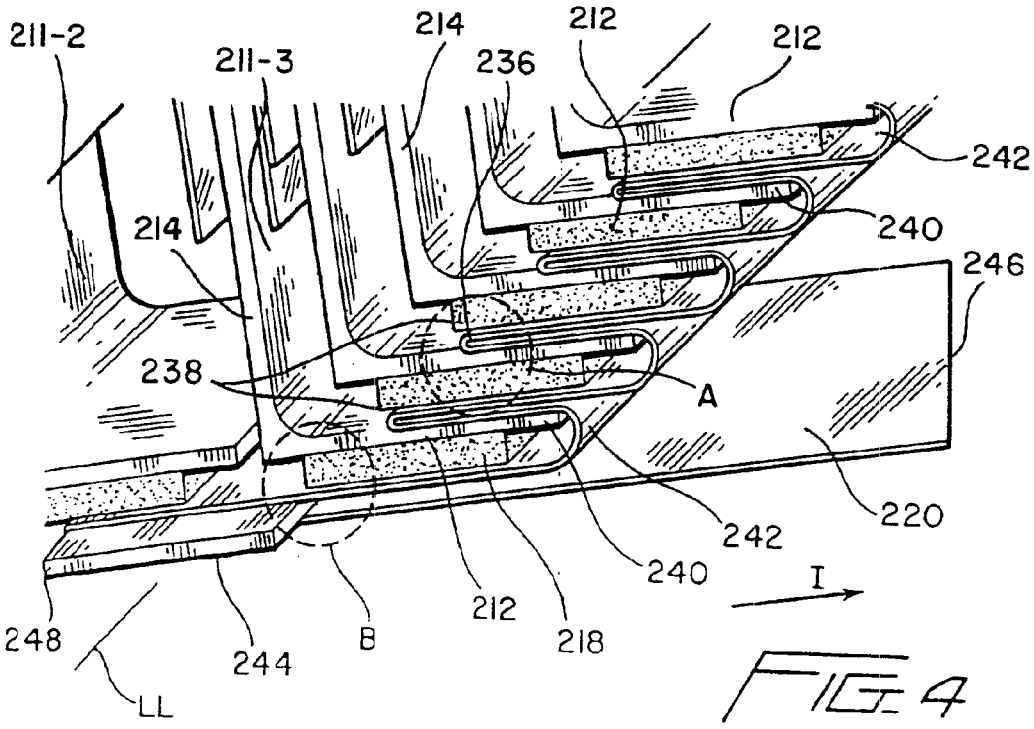
FIG. 4 is an enlarged view showing the details of how the release liner or release sheet is fan-folded between successive ones of the nested or collated individual temporary raised pavement markers (TRPMs) and how the release liner or release sheet is routed around the stripper plate component of the temporary raised pavement marker (TRPM) dispensing system in order to effectively separate individual temporary raised pavement markers (TRPMs) from the plurality of nested or collated temporary raised pavement markers (TRPMs) in preparation for the application or deposition of the temporary raised pavement markers (TRPMs) onto the pavement surface.

Referring now to the drawings, and more particularly to FIGS. 3 and 4 thereof, the new and improved collated array of temporary raised pavement markers (TRPMs) will be disclosed first, and it is seen that such an array is generally indicated by the reference character 210. As can be readily appreciated, the new and improved collated array of temporary raised pavement markers (TRPMs) 210 is seen to comprise a plurality of temporary raised pavement markers (TRPMs) 211 each of which is substantially similar to the temporary raised pavement marker (TRPM) 110 as illustrated within FIG. 2 in that each temporary raised pavement marker (TRPM) 211 has a substantially L-shaped configuration and comprises a relatively short, normally horizontally oriented leg member 212, and a relatively long, normally vertically oriented leg member 214.

A transitional corner region 216 integrally interconnects the leg members 212,214 of each temporary raised pavement marker (TRPM) 211 together, and a protective cover 226, having a substantially inverted U-shaped configuration, is disposed over the upper free edge portion of the normally vertically oriented leg member 214 of each temporary raised pavement marker (TRPM) 211. Each temporary raised pavement marker (TRPM) 211 also has an adhesive pad or block member 218 fixedly secured to the undersurface portion of the relatively short, normally horizontally oriented leg member 212, and in accordance with a first unique and novel feature characteristic of the collated array of temporary raised pavement markers (TRPMs) 210 of the present invention, the adhesive pads or block members 218 of the plurality of temporary raised pavement markers (TRPMs) 211 are all removably disposed upon a single or common release sheet or release liner 220. In accordance with another unique and novel feature characteristic of the collated array of temporary raised pavement markers (TRPMs) 210 of the present invention, it is further appreciated, from the right side portion of FIG. 3, that the plurality of temporary raised pavement markers (TRPMs) 211 are initially mounted upon the single or common release sheet or release liner 220, at predetermined locations spaced along the longitudinal extent of the release sheet or release liner 220 and in a particular manner, such that predetermined equal distances are defined between successive ones of the plurality of temporary raised pavement markers (TRPMs) 211. Subsequently, as can be further appreciated from the left side portion of FIG. 3, as well as from FIGS. 4–7, the plurality of temporary raised pavement markers (TRPMs) 211 are adapted to be disposed in the nested or collated array 210 with respect to each other. More particularly, it is seen that the relatively short leg members 212 of successive ones of the plurality of temporary raised pavement markers (TRPMs) 211 are disposed atop or partially overlap each other such that the transitional corner regions 216 of the plurality of temporary raised pavement markers (TRPMs) 211 effectively define a linear locus LL which is oriented at a predetermined inclination or dispensing angle A with respect to the roadway surface 230 as may best be appreciated from FIGS. 5 and 7.

With reference continuing to be made to FIG. 3, additional unique and novel features characteristic of the collated array of temporary raised pavement markers (TRPMs) 210 of the present invention will also be appreciated. More particularly, it is seen that an additional unique and novel feature characteristic of the collated array of temporary raised pavement markers (TRPMs) 210 of the present invention resides in the fact that the lateral width W of the release sheet or release liner 220 is greater than the lateral width of each one of the temporary raised pavement markers (TRPMs) 211, and most importantly, the lateral width W of the release sheet or release liner 220 is greater than the lateral width of each relatively short leg member 212 and the associated underlying adhesive pad or block member 218 of each one of the temporary raised pavement markers (TRPMs) 211. The reason for this is that when the plurality of temporary raised pavement markers (TRPMs) 211 are disposed within the collated array of temporary raised pavement markers (TRPMs) 210 in preparation for being serially dispensed and applied to the roadway surface 230, as disclosed, for example, within FIG. 5, the collated array of temporary raised pavement markers (TRPMs) 210 are adapted to be disposed within an inclined conveyor box or container, not shown for clarity purposes, through which the plurality of temporary raised pavement markers (TRPMs) 211 are effectively conveyed as will become more apparent hereinafter.

Accordingly, the lateral side edge portions of the release sheet or release liner 220 will effectively be folded upwardly alongside the lateral side edge portions of each relatively short leg member 212 of each temporary raised pavement marker (TRPM) 211 so as to effectively cover the lateral side edge portions of each adhesive pad or block member 218 whereby such lateral side edge portions of the adhesive pads or block members 218 cannot adhere or become stuck to the interior side wall portions of the conveyor box or container, not shown, within which the plurality of temporary raised pavement markers (TRPMs) 211 are disposed. The aforenoted conveyor box or container, not shown, is of course open at both the lower and upper regions thereof so as to permit the plurality of temporary raised pavement markers (TRPMs) 211 to be respectively dispensed onto the roadway surface 230 as well as to permit a fresh supply of temporary raised pavement markers (TRPMs) 211 to be inserted into the conveyor box or container, not shown, for ultimate use in dispensing the temporary raised pavement markers (TRPMs) 211 onto the roadway surface 230.

Still yet further, with particular reference being additionally made to FIG. 4, another unique feature characteristic of the collated array of temporary raised pavement markers (TRPMs) 210 is that when the temporary raised pavement markers (TRPMs) 211 are disposed within the nested or collated array of temporary raised pavement markers (TRPMs) 210, as seen within the left side portion of FIG. 3 as well as within FIGS. 4–7, the release sheet or release liner 220 is disposed within a fan-folded array between each successive pair of the nested or partially overlapped relatively short leg members 212 of the plurality of temporary raised pavement markers (TRPMs) 211. It is seen, for example, that when the release sheet or release liner 220 is formed into its fan-folded array or state, the release sheet or release liner 220 extends downstream from a trailing, upstream, or supply end portion 234 of the release sheet or release liner 220, as may best be appreciated from FIGS. 3 and 5, and as such, the release sheet or release liner 220 is disposed beneath the adhesive pad or block member 218 of each one of the temporary raised pavement markers (TRPMs) 211 whereby the temporary raised pavement markers (TRPMs) 211 are initially disposed upon the release sheet or release liner 220 at predetermined longitudinally spaced locations thereof. Once the plurality of temporary raised pavement markers (TRPMs) 211 are secured upon the common release liner or release sheet 220, the temporary raised pavement markers (TRPMs) 211 are then adapted to be disposed within their nested or collated array 210 with respect to each other.

More particularly, it is noted that, as a result of the disposition of the temporary raised pavement markers (TRPMs) 211 within the collated or nested array of temporary raised pavement markers (TRPMs) 210, as may best be appreciated from FIG. 4, the release sheet or release liner 220 extends rearwardly beneath each one of the adhesive pads or block members 218 of each temporary raised pavement marker (TRPM) 211 and is folded so as to form a rearwardly disposed or oriented loop portion 236 beneath a rear or trailing edge portion 238 of each adhesive pad or block member 218 as disclosed within the encircled area A of FIG. 4. The release sheet or release liner 220 is then routed across the upper surface portion of each one of the relatively short leg members 212 of the plurality of temporary raised pavement markers (TRPMs) 211 and is subsequently folded and routed around the forward or leading edge portion 240 of each one of the relatively short leg members 212 of the plurality of temporary raised pavement markers (TRPMs) 211 so as to form a forwardly disposed or oriented loop portion 242. Ultimately, the release liner or release sheet 220 will extend rearwardly beneath the adhesive pad or block member 218 of the lowermost one of the temporary raised pavement markers (TRPMs) 211 of the collated or nested array of temporary raised pavement markers (TRPMs) 210 in preparation for the individual dispensing of the temporary raised pavement markers (TRPMs) 211 from the collated or nested array of temporary raised pavement markers (TRPMs) 210 and the application of the dispensed temporary raised pavement markers (TRPMs) 211 onto the roadway surface 230.

As can be further appreciated from FIGS. 4, 5, and 7, in order to individually and serially dispense or separate the plurality of temporary raised pavement markers (TRPMs) 211 from the collated array of temporary raised pavement markers (TRPMs) 210, and in order to subsequently apply the individually separated temporary raised pavement markers (TRPMs) 211 onto the roadway surface 230, a fixed stripper plate 244 is disposed at the lower end portion of the inclined collated array of the temporary raised pavement markers (TRPMs) 210, and it is seen that a leading end portion 246 of the release sheet or release liner 220 is routed around a trailing edge portion 248 of the stripper plate 244 so as to be drivingly connected to a release sheet or release liner take-up mechanism which is generally indicated by the reference character 250 as best appreciated from FIGS. 5 and 6. More particularly, the release sheet or release liner take-up mechanism 250 is seen to comprise an indexable roller 252, and a nip roller 254 is operatively associated with and biased into contact with the indexable roller 252 so as to define a nip therewith. The leading end portion 246 of the release sheet or release liner 220 is seen to be routed around the indexable roller 252 so as to initially pass beneath the indexable roller 252 and then over the upper side portion of the indexable roller 252 so as to pass through the nip defined between the indexable roller 252 and the nip roller 254. After passing through the nip defined between the indexable roller 252 and the nip roller 254, the leading end portion 246 of the release sheet or release liner 220 is passed over the nip roller 254 and is operatively fixed to a winder spool or take-up spool 256.

It is seen further that the indexable roller 252 is operatively connected to a drive motor 258 so as to be driven thereby, and the drive motor 258 is operatively connected to a program logic controller (PLC) 260 so as to be controlled thereby in a predetermined indexable manner. More particularly, and as will become more apparent hereinafter, when the program logic controller (PLC) 260 incrementally activates the indexable drive motor 258, the indexable drive motor 258 will cause the a predetermined length of the release sheet or release liner 220 to be longitudinally advanced, at a predetermined time, in order to successively dispense the leading or lowermost one of the temporary raised pavement markers (TRPMs) 211 from the nested or collated array of temporary raised pavement markers (TRPMs) 210 such that the temporary raised pavement markers (TRPMs) 211 can be applied onto the roadway surface 230 with predetermined distances defined between successive temporary raised pavement markers (TRPMs) 211. The program logic controller (PLC) 260 is also operatively connected to the winder spool or take-up spool 256 so as to activate the same, after the indexable roller 252 has been incrementally rotated, so as to effectively take-up or wind the slackened amount of release sheet or release liner 220 thereon. The take-up spool or winder spool 256 may have a suitable variable slip clutch mechanism, not shown, operatively associated therewith such that an excessive amount of wind-up torque is not impressed upon either the take-up spool or winder spool 256, the release sheet or release liner 220, or the nip roller 254.

It is noted further that a suitable mechanism, also not shown, may be employed to effectively bias or pre-load the nip roller 254 into contact with the indexable roller 252 such that a predetermined amount of pressure is effectively maintained between the indexable roller 252 and the nip roller 254 in order to drivably advance the release sheet or release liner 220 through the nip, defined between the indexable roller 252 and the nip roller 254, when desired. It is additionally noted that the program logic controller (PLC) 260 directly controls the indexable roller 252, as opposed to, for example, indexably controlling the take-up spool or winder spool 256, in order to indexably advance the release sheet or release liner 220, in view of the fact that as those portions of the release sheet or release liner 220, which have already been stripped from the individual temporary raised pavement markers (TRPMs) 211, are accumulated upon the take-up spool or winder spool 256, the diameter of the release sheet or release liner 220, as taken-up, wound, and accumulated upon the take-up spool or winder spool 256, is progressively increased. Therefore, if the program logic controller (PLC) 260 directly indexably advanced the take-up spool or winder spool 256 through means of a predetermined angular extent, different linear amounts of the release liner or release sheet 220 would effectively be advanced thereby advancing the individual temporary raised pavement markers (TRPMs) 211 through non-uniform distances. Accordingly, with reference still being made to FIGS. 4–7, when the program logic controller (PLC) 260 transmits a suitable control signal to the indexable roller drive motor 258 for indexably driving the indexable roller 252, the indexable roller 252 and the nip roller 254 will cooperate together so as to advance the leading end portion 246 of the release sheet or release liner 220 a predetermined amount in order to separate the leading or lowermost one of the temporary raised pavement markers (TRPMs) 211 from the nested or collated array of temporary raised pavement markers (TRPMs) 210 in order to effectively dispense the leading or lowermost one of the temporary raised pavement markers (TRPMs) 211 onto the roadway surface 230.

Figure 7:
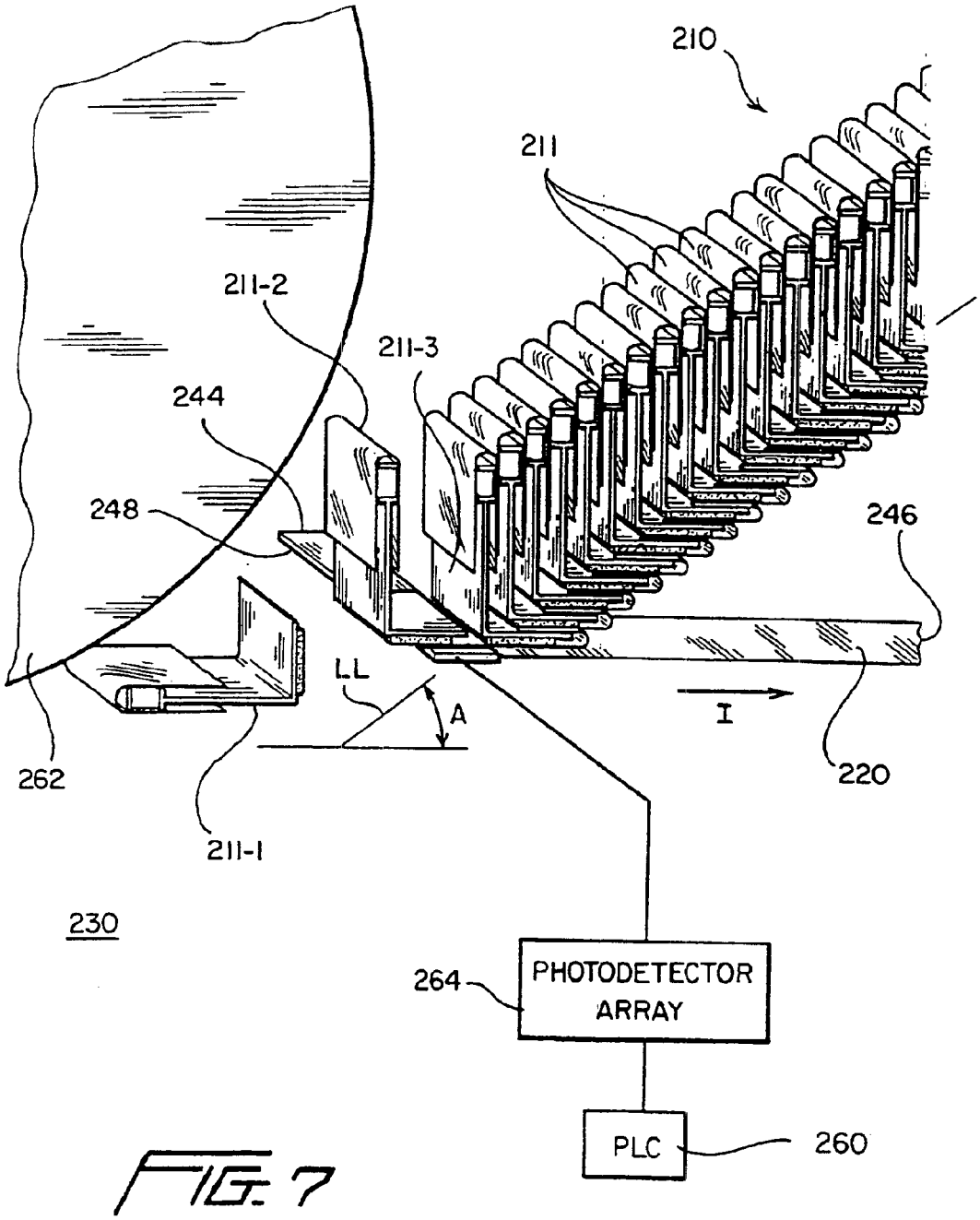
FIG. 7 is a side elevational view showing an individual leading temporary raised pavement marker (TRPM), as separated from the nested or collated array of temporary raised pavement markers (TRPMs), wherein the individual separated temporary raised pavement marker (TRPM) is disposed in a prone position upon the pavement surface in preparation for movement to its erected or upright position so as to be fixed upon the pavement surface by an application wheel of the temporary raised pavement marker (TRPM) application system.

More particularly, as best seen in FIGS. 4 and 7, a first, leading, or lowermost one of the temporary raised pavement markers (TRPMs) 211 of the originally nested or collated array of temporary raised pavement markers (TRPMs) 210 is illustrated at 211-1, a second one of the temporary raised pavement markers (TRPMs) 211 of the originally nested or collated array of temporary raised pavement markers (TRPMs) 210 is illustrated at 211-2, and a third one of the temporary raised pavement markers (TRPMs) 211 of the originally nested or collated array of temporary raised pavement markers (TRPMs) 210 is illustrated at 211-3 for explanatory purposes. When, for example, a leading one of the temporary raised pavement marker (TRPM) 211 is to be initially separated from the temporary raised pavement markers (TRPMs) 211 disposed within the collated or nested array of temporary raised pavement markers (TRPMs) 210 so as to be moved, for example, from the position occupied by means of the illustrated temporary raised pavement marker (TRPM) 211-3 to the position occupied by means of the illustrated temporary raised pavement marker (TRPM) 211-2, the release sheet or release liner 220 will be advanced in the forward direction I by means of the indexable roller 252, cooperating with the nip roller 254, as driven by means of the motor drive 258 in accordance with an activation control signal issued by means of the program logic controller (PLC) 260.

Accordingly, the leading one of the temporary raised pavement markers (TRPMs) 211 will effectively be separated from the nested or collated array of the temporary raised pavement markers (TRPM) 210 and will be disposed at the position occupied by means of the temporary raised pavement marker (TRPM) 211-2 as illustrated within FIGS. 4 and 7. It is also to be noted and appreciated that, as a result of the movement of the leading one of the temporary raised pavement markers (TRPMs) 211 to the illustrated separated position occupied by means of the temporary raised pavement marker (TRPM) 211-2, the folded portion of the release sheet or release liner 220, which previously formed the rearwardly disposed or oriented loop portion 236 disposed beneath the adhesive pad or block member 218 of the second one of the temporary raised pavement markers (TRPMs) 211, has now been unfolded and effectively eliminated as is illustrated within the encircled region B of FIG. 4. This procedure is critically important for readily facilitating the peeling or separation of the release sheet or release liner 220 from each one of the temporary raised pavement markers (TRPMs) 211 such that each one of the temporary raised pavement markers (TRPMs) 211 can in fact be dispensed and disposed upon the pavement or roadway surface 230 as is illustrated by means of the temporary raised pavement marker (TRPM) 211-1. It is to be noted, with particular reference again being made to the encircled region A of FIG. 4, that, in accordance with the unique and novel techniques of forming the collated or nested array of the temporary raised pavement markers (TRPMs) 210 of the present invention, the disposition or location of each rearwardly disposed or oriented loop portion 236 of the release sheet or release liner 220, as disposed or located beneath the rear or trailing edge portion 238 of each adhesive pad or block member 218, is such that each rearwardly disposed or oriented loop portion 236 is actually set inwardly, as considered in the forward direction I, with respect to the rear edge portions 238 of each adhesive pad or block member 218.

It will also be recalled, as has been noted hereinbefore, that after the adhesive material, which was originally or initially applied or deposited in a heated state onto the undersurface portion of the relatively short leg member of the elongated temporary raised pavement marker (TRPM) structure, from which the individual temporary raised pavement markers (TRPMs) 211 were subsequently cut and formed, the adhesive material subsequently cools, and as a result of such cooling process, the adhesive material undergoes a predetermined amount of contraction or shrinkage. Such contraction or shrinkage of the adhesive material effectively forms a bond structure between the primary mass of the adhesive material and the release liner which includes and partially defines the aforenoted feather-edge bond boundary or line of demarcation. It can therefore be additionally appreciated from the structural arrangement of the collated or nested array of temporary raised pavement markers (TRPMs) 210, as disclosed within FIG. 4 and comprising the plurality of temporary raised pavement markers (TRPMs) 211, the plurality of adhesive pads or block members 218, and the fan-folded release sheet or release liner 220, that the aforenoted feather-edge bond boundaries, characteristic of the collated or nested array of temporary raised pavement markers (TRPMs) 210 of the present invention, are formed at the junction of each rearwardly disposed or oriented loop portion 236 of the release liner or release sheet 220 and rear edge regions of each adhesive pad or block member 218.

Consequently, as can be appreciated still further, and unlike or contrary to conventional or PRIOR ART temporary raised pavement markers (TRPMs), as disclosed, for example, within FIG. 2, wherein the locations of such feather-edge bond boundaries are rearward or external of the rear edge portion of each individual adhesive pad or block member 118, the locations of the feather-edge bond boundaries of the present invention, as defined between the rearwardly disposed or oriented loop portions 236 of the release liner or release sheet 220 and the rear edge regions of the adhesive pads or block members 218, are effectively positioned forwardly of the rear edge portions 238 of the adhesive pads or block members 218 so as to effectively be disposed beneath each adhesive pad or block member 218. In this manner, when the individual portions of the release sheet or release liner 220, which form the individual rearwardly disposed or oriented loop portions 236 as defined between successively collated or nested temporary raised pavement markers (TRPMs) 211, are effectively unfolded as a result of, for example, a particular one of the temporary raised pavement markers (TRPMs) 211 being moved from the position depicted by temporary raised pavement marker (TRPM) 211-3 to the position depicted by temporary raised pavement marker (TRPM) 211-2, as seen in FIGS. 4 and 7, then the feather-edge bond boundary, defined between each section of the release sheet or release liner 220 and the adhesive pad or block member 218 of an associated one of the temporary raised pavement markers (TRPMs) 211, is effectively recombined with the primary mass comprising the adhesive pad or block member 218 of the particular one of the temporary raised pavement markers (TRPMs) 211.

In view of the fact that the chemical and structural affinity of the feather-edge bond structure, defined at the feather-edge bond boundary, is substantially greater with respect to the primary mass of adhesive material comprising the adhesive pad or block member 218, as opposed to the affinity of the feather-edge bond structure with respect to release sheet or release liner 220, then the recombining of such feather-edge bond structure with the primary mass of adhesive material comprising the adhesive pad or block member 218 effectively permits the feather-edge bond structure to be completely assimilated within the primary mass of adhesive material comprising the adhesive pad or block member 218. Such assimilation, in turn, effectively eliminates the adverse structural characteristics of the feather-edge bond structure, that is, the flimsy but flexible nature of the same, characterized by relatively high tensile strength properties, which otherwise prevents the readily easy separation, peeling, or stripping of the release sheet or release liner 220 from the particular one of the adhesive pads or block members 218 disposed upon a particular one of the temporary raised pavement markers (TRPMs) 211 to be deposited or applied onto the roadway surface 230. Accordingly, as a result of such effective assimilation of the feather-edge bond structure into or with the primary mass of adhesive material comprising the adhesive pad or block member 218, this processing permits the release sheet or release liner 220 to be easily peeled, stripped, and separated from the adhesive pad or block member 218 of each one of the temporary raised pavement markers (TRPMs) 211 such that the individual temporary raised pavement markers (TRPMs) 211 can in fact be applied onto the roadway surface 230.

Figure 5:
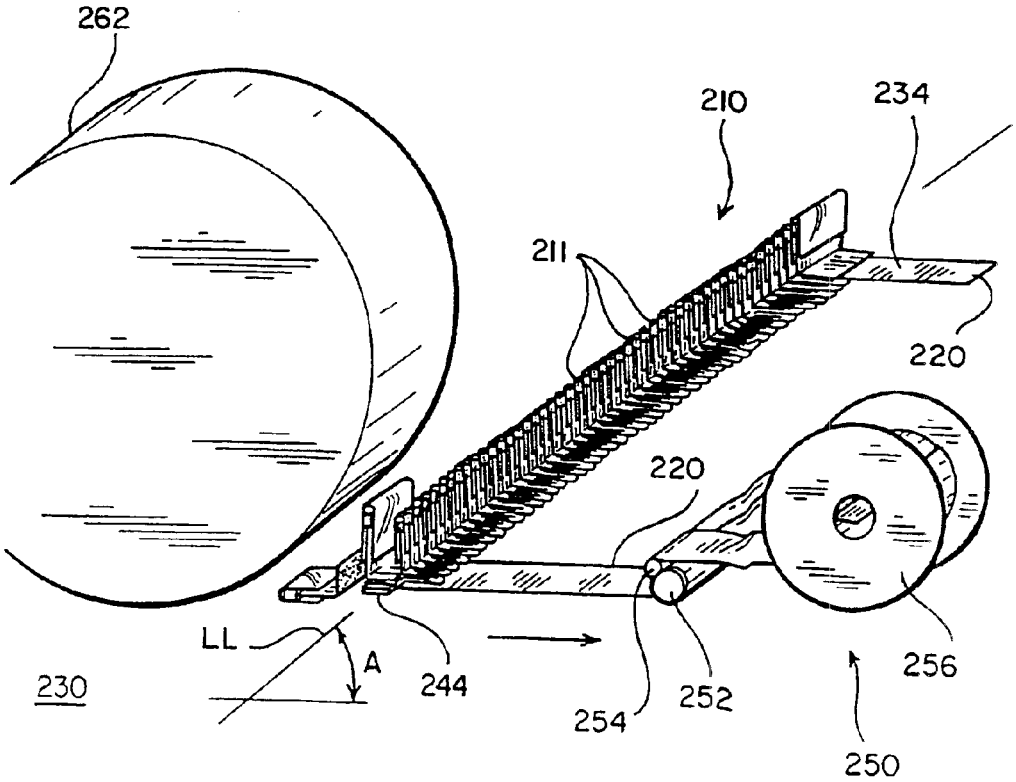
FIG. 5 is a side elevational view showing the various structural components comprising the overall system utilized for conveying the plurality of temporary raised pavement markers (TRPMs) in their nested or collated array, for separating individual temporary raised pavement markers (TRPMs) from the plurality of nested or collated array of temporary raised pavement markers (TRPMs), and for dispensing and applying the separated individual temporary raised pavement markers (TRPMs) onto the pavement surface.

In connection with the actual deposition or application of the individual temporary raised pavement markers (TRPMs) 211 onto the roadway surface 230, and with particular reference being made to FIGS. 4, 5 and 7, it is to be appreciated that as the release sheet or release liner 220 is being peeled or stripped from, for example, the second one of the temporary raised pavement markers (TRPMs) 211-2 and routed around the rear edge portion 248 of the stripper plate 244, the second temporary raised pavement marker (TRPM) 211-2 will tend to rotate or pivot around the rear edge portion 248 of the stripper plate 244 such that the second temporary raised pavement marker (TRPM) 211-2 will eventually be disposed upon the roadway surface 230 at the position depicted by means of the first temporary raised pavement marker (TRPMs) 211-1 within FIG. 7 wherein, for example, the normally upright or vertically oriented leg member 214 of the temporary raised pavement marker (TRPM) 211-1 is disposed or oriented horizontally, while the normally horizontally oriented leg member 212 of the temporary raised pavement marker (TRPM) 211-1 is disposed or oriented vertically. It is additionally noted that in accordance with the system for applying the temporary raised pavement markers (TRPMs) 211 onto the roadway surface 230, the various structural components comprising the temporary raised pavement marker (TRPM) deposition or application system of the present invention are adapted to be operationally mounted upon a portable, wheeled vehicle structure which may be effectively towed by means of a suitable roadway service truck or vehicle of the type disclosed within United States Patent Application which is entitled TEMPORARY RAISED PAVEMENT MARKER (TRPM) APPLICATOR MACHINE FOR AUTOMATICALLY APPLYING PAVEMENT MARKERS TO ROAD SURFACES, which was filed on Sep. 20, 2002, and which has been assigned Ser. No. 10/247,436.

Accordingly, as disclosed within FIGS. 5 and 7, an application wheel 262 of the towed vehicle, not shown, is disposed rearwardly of the lower end portion of the conveyor box or container, not shown, within which the collated or nested array of temporary raised pavement markers (TRPMs) 210 is disposed. In this manner, immediately after the first one of the temporary raised pavement markers (TRPMs) 211 is disposed at the position depicted by means of the temporary raised pavement marker (TRPM) 211-1 as disclosed within FIG. 7, the application wheel 262 rolls over the first temporary raised pavement marker (TRPM) 211-1 and causes the vertically upright short leg member 212 of the first temporary raised pavement marker (TRPM) 211-1 to be effectively pivoted around the axis defined by means of the transitional corner region 216 of the first temporary raised pavement marker (TRPM) 211-1 such that the adhesive pad or block member 218 of the first temporary raised pavement marker (TRPM) 211-1 is now pressed into contact with the roadway surface 230 in order to adhesively bond the first temporary raised pavement marker (TRPM) 211-1 onto the roadway surface 230. It is noted that during the application of the first temporary raised pavement marker (TRPM) 211-1 onto the roadway surface 230, at no time does the application wheel 262 contact the exposed adhesive pad or block member 218 disposed upon the temporary raised pavement marker (TRPM) 211-1.

Subsequently, as the application wheel 230 passes over and beyond the first temporary raised pavement marker (TRPM) 211-1, which is now fixedly bonded to the roadway surface 230, the resiliency of the temporary raised pavement marker (TRPM) 211-1, which is inherently characteristic of the thermoplastic material from which all of the temporary raised pavement markers (TRPMs) 211 are fabricated, permits the vertically oriented large leg member 214 of the first temporary raised pavement marker (TRPM) 211-1 to attain and regain its normally upright, vertical orientation. It can of course be further appreciated that the plurality of temporary raised pavement markers (TRPMs) 211 are able to be accordingly successively or serially dispensed and deposited or applied onto the roadway surface 230 as a result of the indexable roller 252 being operationally indexed by means of its drive motor 258 which, in turn, is under the control of the program logic controller (PLC) 260 which issues energization signals at predeterminedly timed intervals such that the plurality of temporary raised pavement markers (TRPMs) 211 are applied to the roadway surface 230 at predeterminedly spaced locations along the roadway surface 230. It is noted in conjunction with the dispensing and application of the plurality of temporary raised pavement markers (TRPMs) 211 onto the roadway surface 230 that a suitable sensor, such as, for example, a photodetector array 264 may be disposed within the vicinity of the stripper plate 248, as illustrated, for example, within FIG. 7. Accordingly, whenever the photodetector array 264 detects the presence of a successive one of the temporary raised pavement markers (TRPMs) 211, a signal is transmitted to the program logic controller (PLC) 260 so as to initiate an index motor drive movement at a predetermined time in order to dispense and apply another temporary raised pavement marker (TRPM) 211 onto the roadway surface 230.

It is lastly noted that when a particular collated or nested array of temporary raised pavement markers (TRPMs) 210 have been deposited and applied onto the roadway surface 230, and the supply of temporary raised pavement markers (TRPMs) 211 disposed upon a particular section or length of release sheet or release liner 220 has been depleted or exhausted, a new or fresh supply of temporary raised pavement markers (TRPMs) 211 can be deposited and applied to the roadway surface 230 simply by means of effectively connecting a leading end portion 246 of the new or fresh release sheet or release liner 220, having a new or fresh supply of temporary raised pavement markers (TRPMs) 211 disposed thereon, to the trailing end portion 234 of the exhausted or depleted release sheet or release liner 220. The connection means for the release sheets or release liners 220 may vary, such as, for example, a suitable adhesive may be applied to the leader and trailer sections 246,234, or alternatively, other mechanical means may be employed. In either case, continuous automatic operation of the temporary raised pavement marker (TRPM) application system can be achieved. It is likewise noted that while the various structural and operational components of the temporary raised pavement marker (TRPM) application system, as disclosed, for example, within FIG. 5, are substantially aligned within a single vertical plane, that is, the winder or take-up spool 256 is disposed forwardly of the inclined array of temporary raised pavement markers (TRPMs) 210, and in turn, the array of temporary raised pavement markers (TRPMs) 210 is disposed forwardly of the applicator wheel 262 of the wheeled vehicle, such an arrangement is not necessarily mandatory.

Alternatively, for example, the stripper plate 244 may be disposed at a predetermined angle with respect to, for example, the plane within which the applicator wheel 262 is disposed whereby the longitudinal extent of the applicator system may be effectively shortened while the lateral extent of the applicator system may be accordingly extended. In this manner, different spatial requirements may be accommodated. Still further, while the applicator system of the present invention has been disclosed as being capable of depositing or applying a single line of temporary raised pavement markers (TRPMs) 211 onto the roadway surface, similar, side-by-side systems may be effectively arranged so as to be capable of simultaneously depositing or applying a dual row of temporary raised pavement markers (TRPMs) 211 as has also been disclosed within the aforenoted United States Patent Application entitled TEMPORARY RAISED PAVEMENT MARKER (TRPM) APPLICATOR MACHINE FOR AUTOMATICALLY APPLYING PAVEMENT MARKERS TO ROAD SURFACES, filed on Sep. 20, 2002, and assigned Ser. No. 10/247,436.

It is to be appreciated still further that while the aforenoted new and improved road marker collated assembly, and the system and method for applying road markers to roadway surfaces, have been disclosed, in accordance with the principles and teachings of the present invention, as being utilized in conjunction with the temporary raised pavement markers (TRPMs), the new and improved road marker collated assembly, and the system and method for applying road markers to roadway surfaces, are equally applicable, in accordance with the principles and teachings of the present invention, for use in conjunction with permanent raised pavement markers (RPMs). Accordingly, as can be appreciated from FIGS. 8 and 9, a new and improved collated array of permanent raised pavement markers (RPMs) is disclosed and is generally indicated by the reference character 310, it being noted that as disclosed within FIG. 8, the permanent raised pavement markers (RPMs) and the associated release sheet or release liner are disposed within their fan-folded collated array, while as disclosed within FIG. 9, the permanent raised pavement markers (RPMs) and the associated release sheet or release liner are shown prior to the actual adhesive bonding of the permanent raised pavement markers (RPMs) onto the release sheet or release liner and the subsequent fan-folding of the components into the aforenoted fan-folded collated array.

Figure 8:
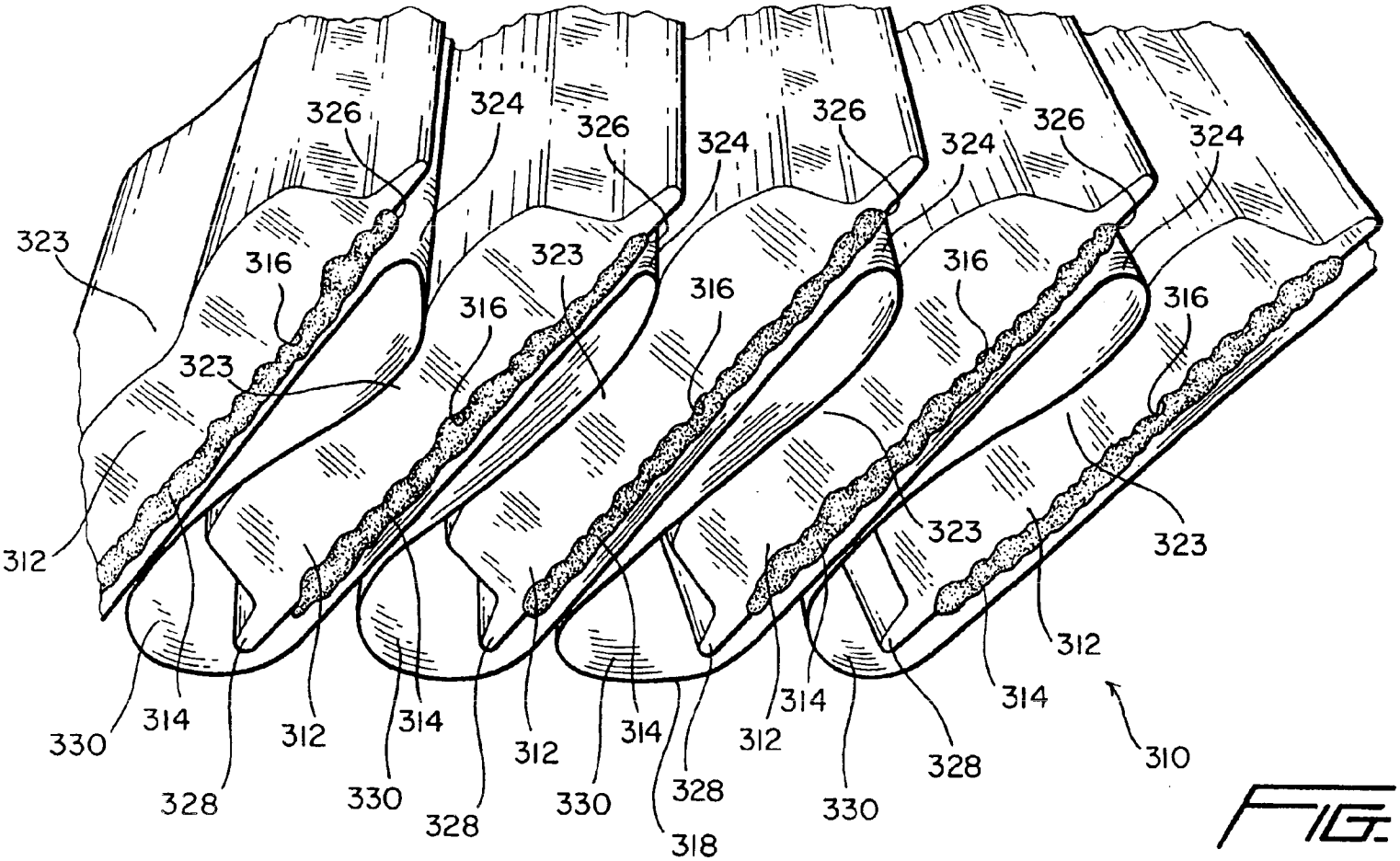
FIG. 8 is a side perspective view of a plurality of permanent half-track raised pavement markers (RPMs) showing the same being arranged within their collated state or array upon their release sheet or release liner in accordance with the unique and novel teachings and principles of the present invention.
Figure 9:
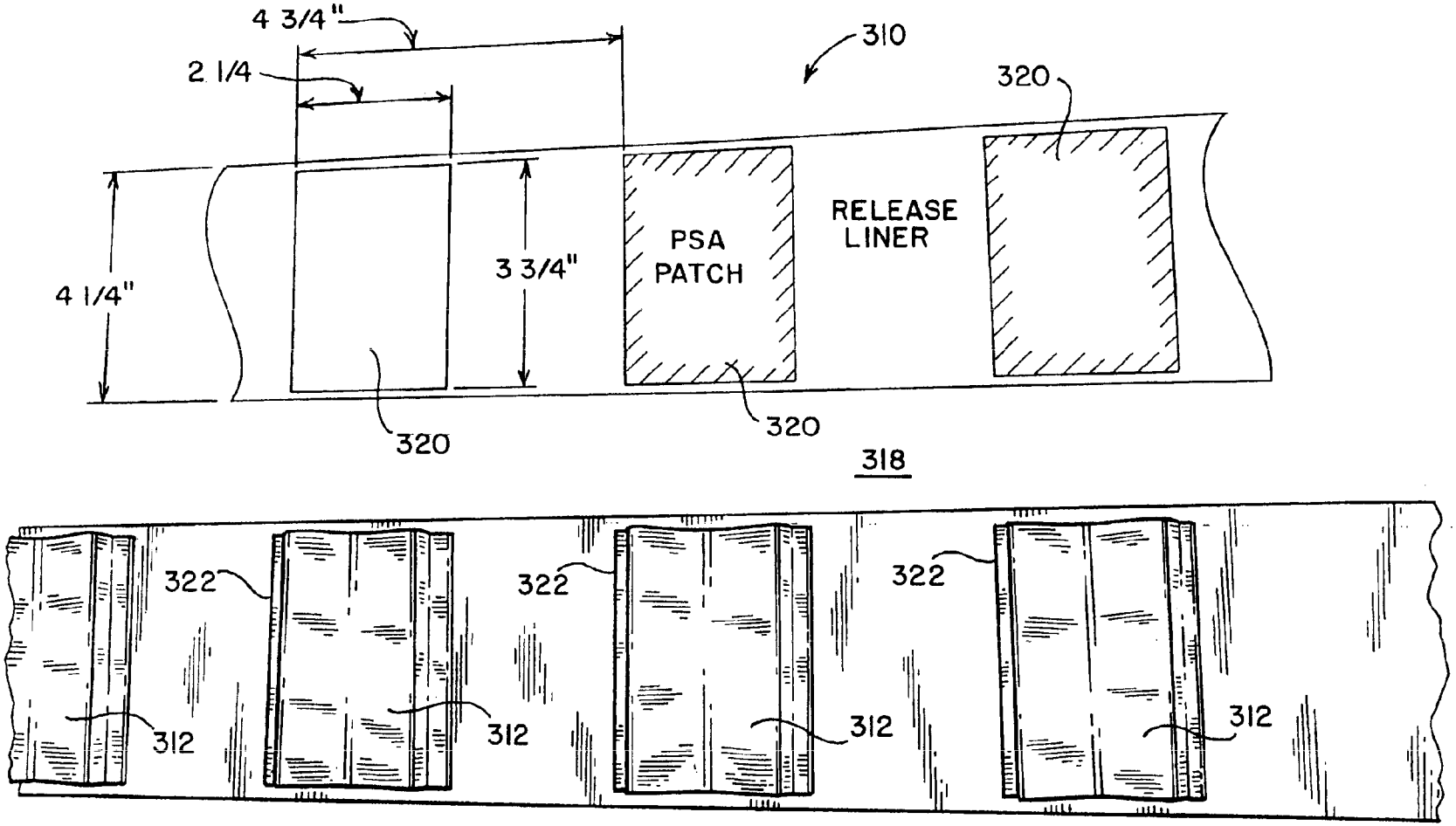
FIG. 9 is a top plan view of a plurality of the permanent half-track raised pavement markers (RPMs), such as those disclosed within FIG. 8, showing the predetermined spaced disposition of the permanent half-track raised pavement markers (RPMs) with respect to each other prior to the permanent half-track raised pavement markers (RPMs) actually being adhesively bonded upon the release liner or release sheet and prior to the permanent half-track raised pavement markers (RPMs) and the release liner or release sheet being fan-folded together into the collated array.

More particularly, as can be readily appreciated from FIGS. 8 and 9, the new and improved collated array of permanent raised pavement markers (RPMs) 310 is seen to comprise a plurality of permanent raised pavement markers (RPMs) 312 wherein each one of the permanent raised pavement markers (RPMs) 312 is seen to be similar to the permanent raised pavement markers (RPMs) as illustrated within the aforenoted U.S. Pat. Nos. 5,515,807, 5,392,728, and 5,327,850 which issued to Speer et al. Each one of these permanent raised pavement markers (RPMs) 312 has a substantially rectangular configuration and is known in the industry as a permanent half-track raised pavement marker in that the external dimensions or footprint of each half-track permanent raised pavement marker are approximately two inches (2.00") long and approximately four inches (4.00") wide. Each one of the permanent half-track raised pavement markers (RPMs) 312 has an adhesive pad or block member 314 fixedly secured to the undersurface portion 316 of the permanent half-track raised pavement marker 312, and in accordance with the principles and teachings of the present invention, and in a manner similar to that characteristic of the array of collated temporary raised pavement markers (TRPMs) 210 as disclosed within FIG. 3, the adhesive pads or block members 314 of the plurality of permanent half-track raised pavement markers (RPMs) 312 are all removably disposed upon a single or common release sheet or release liner 318. It is noted that while each adhesive pad or block member 314 may comprise, for example, a suitable epoxy, alternatively, a suitable pressure-sensitive adhesive (PSA) may also be utilized.

In accordance with another unique and novel feature characteristic of the collated array of permanent half-track raised pavement markers (RPMs) 312, and again as was the case with the temporary raised pavement markers (TRPMs) 210 of the present invention as illustrated within FIG. 3, the plurality of permanent half-track raised pavement markers (RPMs) 312 are initially mounted upon the single or common release sheet or release liner 318 at predetermined locations spaced along the longitudinal extent of the release sheet or release liner 318 such that predetermined equal distances are defined between successive ones of the plurality of permanent half-track raised pavement markers (RPMs) 312. More particularly, as can best be appreciated from FIG. 9, each one of the plurality of permanent half-track raised pavement markers (RPMs) 312 is adapted to be secured upon the region 320 of the release sheet or release liner 318 entitled PSA PATCH, and it is seen that the permanent half-track raised pavement markers (RPMs) 312 are longitudinally spaced from each other, along the longitudinal extent of the release sheet or release liner 318, by means of a linear distance of approximately four and three-quarters inches (4.75") as measured from a particular edge portion 322 of each one of the plurality of permanent half-track raised pavement markers (RPMs) 312. As was also the case with the collated array of temporary raised pavement markers (TRPMs) 210, it is also noted that the lateral or widthwise extent of the release sheet or release liner 318 is greater than that of the PSA PATCH region 320 such that the lateral ends of the adhesive do not in fact extend beyond the lateral edges of the release sheet or release liner 318. It will be recalled that the reason for this relative structural arrangement between the plurality of temporary raised pavement markers (TRPMs) 211 and the release sheet or release liner 220 resides in the packaging of the temporary raised pavement markers (TRPMs) 211 in preparation for the serial dispensing and application of the temporary raised pavement markers (TRPMs) 211 onto the roadway surface 230.

In a similar manner, then, as can be further appreciated from FIG. 8, the plurality of permanent half-track raised pavement markers (RPMs) 312 are adapted to be disposed in the nested or collated array 310 with respect to each other whereby the collated array 310 of permanent half-track raised pavement markers (RPMs) 312 can likewise be packaged in a suitable inclined conveyor box or container, not shown for clarity purposes, with the undersurface portion 316 of an upper one of the permanent half-track raised pavement markers (RPMs) 312 disposed atop the upper surface portion 323 of a lower one of the permanent half-track raised pavement markers (RPMs) 312, in preparation for the serial dispensing and application of the permanent half-track raised pavement markers (RPMs) 312 onto the roadway surface 230. As was the case with the temporary raised pavement markers (TRPMs) 211, the disposition of the plurality of permanent half-track raised pavement markers (RPMs) 312 within the inclined conveyor box or container, not shown, permits the plurality of permanent half-track raised pavement markers (RPMs) 312 to be collectively disposed along a linear locus, similar to the linear locus LL characteristic of the array of temporary raised pavement markers (TRPMs) 210 as disclosed within FIG. 5, so as to likewise be capable of being dispensed onto the roadway surface 230 in a manner similar to that illustrated in FIGS. 5 and 7 with respect to the temporary raised pavement markers (TRPMs) 211. More particularly, the collated array of permanent half-track permanent raised pavement markers (RPMs) 312 is adapted to be disposed within the inclined conveyor box or container, not shown, through which the plurality of permanent half-track raised pavement markers (RPMs) 312 can be conveyed without causing interference with the conveyor box or container, not shown.

Accordingly, when the collated nested array or assembly 310 of permanent half-track raised pavement markers (RPMs) 312 is disposed within the inclined conveyor box or container, not shown, the lateral side edge portions of the release sheet or release liner 318 will effectively be folded upwardly alongside the lateral side edge portions of each one of the plurality of permanent half-track raised pavement markers (RPMs) 312 so as to effectively cover the lateral side edge portions of each adhesive pad or block member 314 whereby such lateral side edge portions of the adhesive pads or block members 314 cannot adhere or become stuck to the interior side wall portions of the conveyor box or container, not shown, within which the plurality of permanent half-track raised pavement markers (RPMs) 312 are disposed. The aforenoted conveyor box or container, not shown, is of course open at both the lower and upper regions thereof so as to permit the plurality of permanent half-track raised pavement markers (RPMs) 312 to be respectively dispensed onto the roadway surface 230, as well as to permit a fresh supply of permanent half-track raised pavement markers (RPMs) 312 to be inserted into the conveyor box or container, not shown, for ultimate use in dispensing the plurality of permanent half-track raised pavement markers (RPMs) 312 onto the roadway surface 230.

Still yet further, with particular reference being particularly made to FIG. 8, and as was the case with the collated array of temporary raised pavement markers (TRPMs) 210, when the permanent half-track raised pavement markers (RPMs) 312 are disposed within the nested or collated array of permanent half-track raised pavement markers (RPMs) 312, the release sheet or release liner 318 is disposed within a fan-folded array between each successive pair of the nested or partially overlapped permanent half-track raised pavement markers (RPMs) 312. More particularly, it is seen or appreciated, for example, from FIGS. 8 and 9, that after the plurality of permanent half-track raised pavement markers (RPMs) 312 have been initially disposed upon the release sheet or release liner 318 at the predetermined longitudinally spaced locations thereof, then when the release sheet or release liner 318 is formed into its fan-folded array or state, the release sheet or release liner 318 is disposed beneath the adhesive pad or block member 314 of each one of the permanent half-track raised pavement markers (RPMs) 312 whereby the release sheet or release liner 318 extends rearwardly beneath each one of the adhesive pads or block members 314 of each permanent half-track raised pavement marker (RPM) 312 and is folded so as to form a rearwardly disposed or oriented loop portion 324 beneath a rear or trailing edge portion 326 of each adhesive pad or block member 314 as is clearly disclosed within FIG. 8. The release sheet or release liner 318 is then routed across the upper surface portion of each one of the plurality of permanent half-track raised pavement markers (RPMs) 312 and is subsequently folded and routed around the forward or leading edge portion 328 of each one of the plurality of permanent half-track raised pavement markers (RPMs) 312 so as to form a forwardly disposed or oriented loop portion 330. The collated nested array or assembly 310 of permanent half-track raised pavement markers (RPMs) 312, comprising the release sheet or release liner 318 folded or interwoven between the successive pairs of permanent half-track raised pavement markers (RPMs) 312, is therefore readied whereby individual dispensing of the plurality of permanent half-track raised pavement markers (RPMs) 312 may now be achieved.

Figure 1:
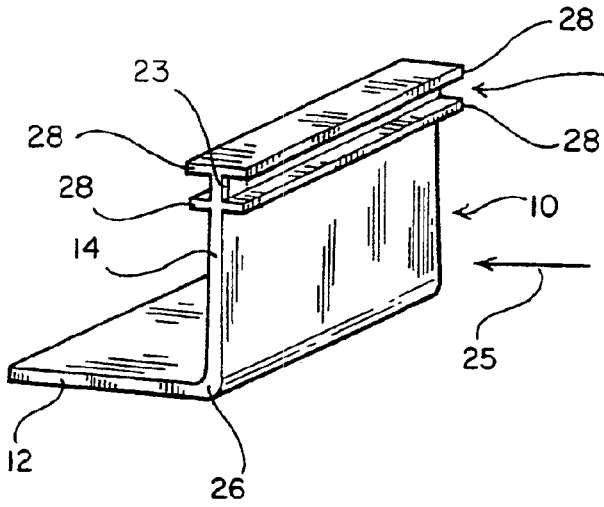
FIG. 1 (PRIOR ART)
FIG. 1 is a perspective view of a first PRIOR ART temporary raised pavement marker (TRPM)
Figure 6:
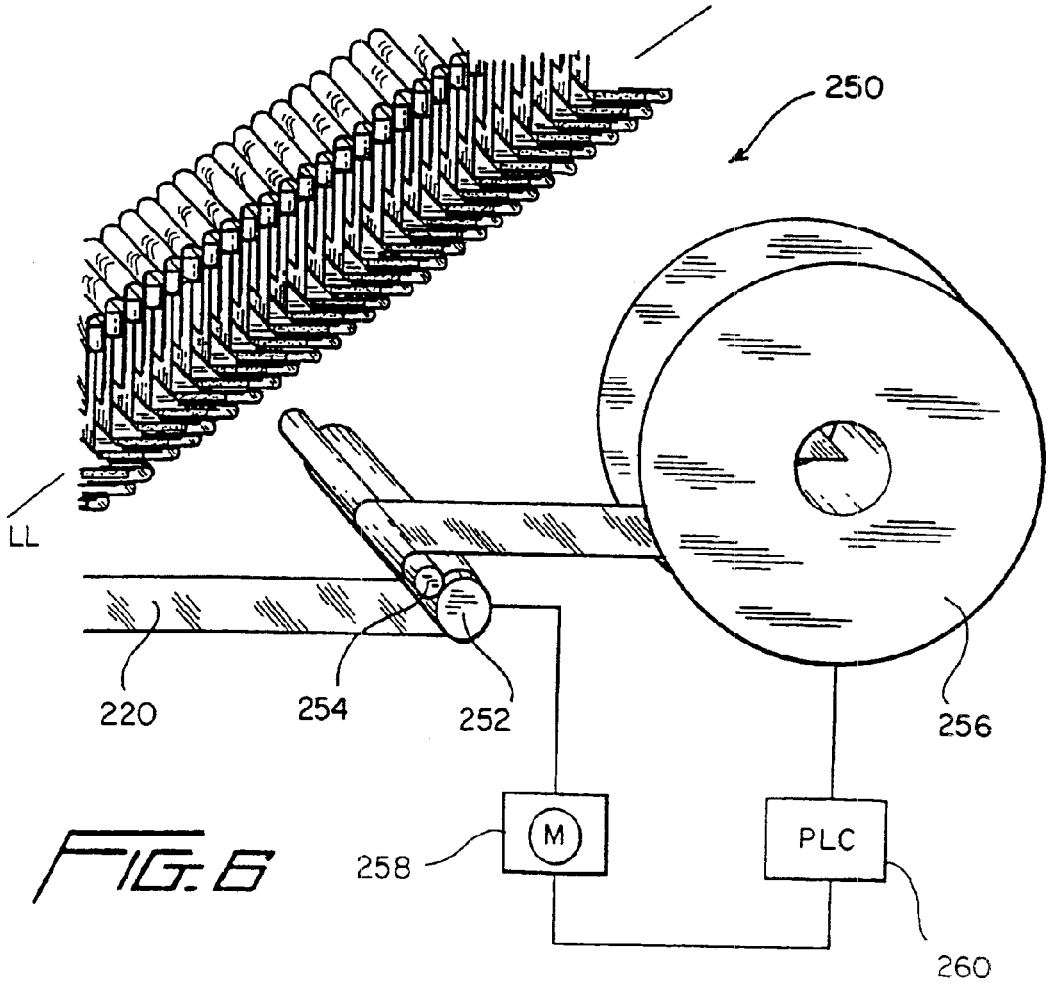
FIG. 6 is an enlarged detailed view of the indexable drive mechanism, of the overall system as shown in FIG. 5, for indexably feeding the nested or collated array of temporary raised pavement markers (TRPMs) in such a manner that the leading one of the temporary raised pavement markers (TRPMs) can be separated from the nested or collated array of temporary raised pavement markers (TRPMs) and therefore be applied to or deposited upon the pavement surface.

With respect to the actual dispensing and application of the individual permanent half-track raised pavement markers (RPMs) 312 onto the roadway surface 230, the system or apparatus as disclosed within FIGS. 5–7, which was utilized in connection with the dispensing and application of the temporary raised pavement markers (TRPMs) 211 onto the roadway surface 230, may likewise be utilized in connection with the dispensing and application of the individual permanent half-track raised pavement markers (RPMs) 312 onto the roadway surface 230. Accordingly, a description of such an operation will be omitted herefrom in the interests of brevity. However, one critical difference between the actual dispensing and application procedure or technique, which is utilized in connection with the dispensing and application of the individual permanent half-track raised pavement markers (RPMs) 312 onto the roadway surface 230, as compared to the dispensing and application procedure or technique, which is utilized in connection with the dispensing and application of the temporary raised pavement markers (TRPMs) 211 onto the roadway surface 230, is to be noted. As will be readily recalled, each one of the temporary raised pavement markers (TRPMs) 211 has a substantially L-shaped cross-sectional configuration and comprises a relatively short, normally horizontally extending leg member 212 and a relatively long, normally vertically extending leg member 214. In addition, when each one of the temporary raised pavement markers (TRPMs) 211 is dispensed onto the roadway surface 230 as illustrated, for example, within FIG. 7, the temporary raised pavement marker (TRPM) 211 is initially disposed in a prone position with the relatively long, normally vertically extending leg member 214 disposed horizontally upon the roadway surface 230.

Accordingly, when the applicator wheel 262 rolls over the dispensed temporary raised pavement marker (TRPM) 211 disposed upon the roadway surface 230, the applicator wheel 262 will cause the temporary raised pavement marker (TRPM) 211 to effectively pivot around the corner or transitional section 216 thereof so as to dispose the temporary raised pavement marker (TRPM) 211 in its normal or upstanding or upright mode whereby the same will be adhesively bonded to the roadway surface 230 by means of the adhesive pad or block member 218 disposed beneath the relatively short, horizontally extending leg member 212. This particular mode of application is not, however, possible in connection with the plurality of permanent half-track raised pavement markers (RPMs) 312 in view of the fact that each one of the permanent half-track raised pavement markers (RPMs) 312 does not have a substantially L-shaped cross-sectional configuration, but, to the contrary, has a substantially flat-plate configuration.

Therefore, it is to be noted that in order to achieve the proper application of individual ones of the permanent half-track raised pavement markers (RPMs) 312 onto the roadway surface 230, the stripper plate 244 of the dispensing system or apparatus, as disclosed within FIGS. 5–7, must be disposed parallel to and immediately above the roadway surface 230 such that the rear or trailing edge portion 326 of each permanent half-track raised pavement marker (RPM) 312 is caused to immediately engage the roadway surface 230, as the same is being discharged by the stripper plate 244 from the release sheet or release liner 318, without permitting the permanent half-track raised pavement marker (RPM) 312 to pivot around the stripper plate 244, as was the case with the dispensing and application of the plurality of temporary raised pavement markers (TRPMs) 211. In this manner, the bottom or undersurface portion 316, having the adhesive pad or block member 314 disposed thereon, can be directly and immediately applied onto the roadway surface 230 whereby the applicator wheel 262 can then roll over the upper surface portion of each permanent half-track raised pavement marker (RPM) 312 so as to fixedly secure the particular permanent half-track raised pavement marker (RPM) 312 to the roadway surface 230 by means of the adhesive pad or block member 318.

Figure 10:
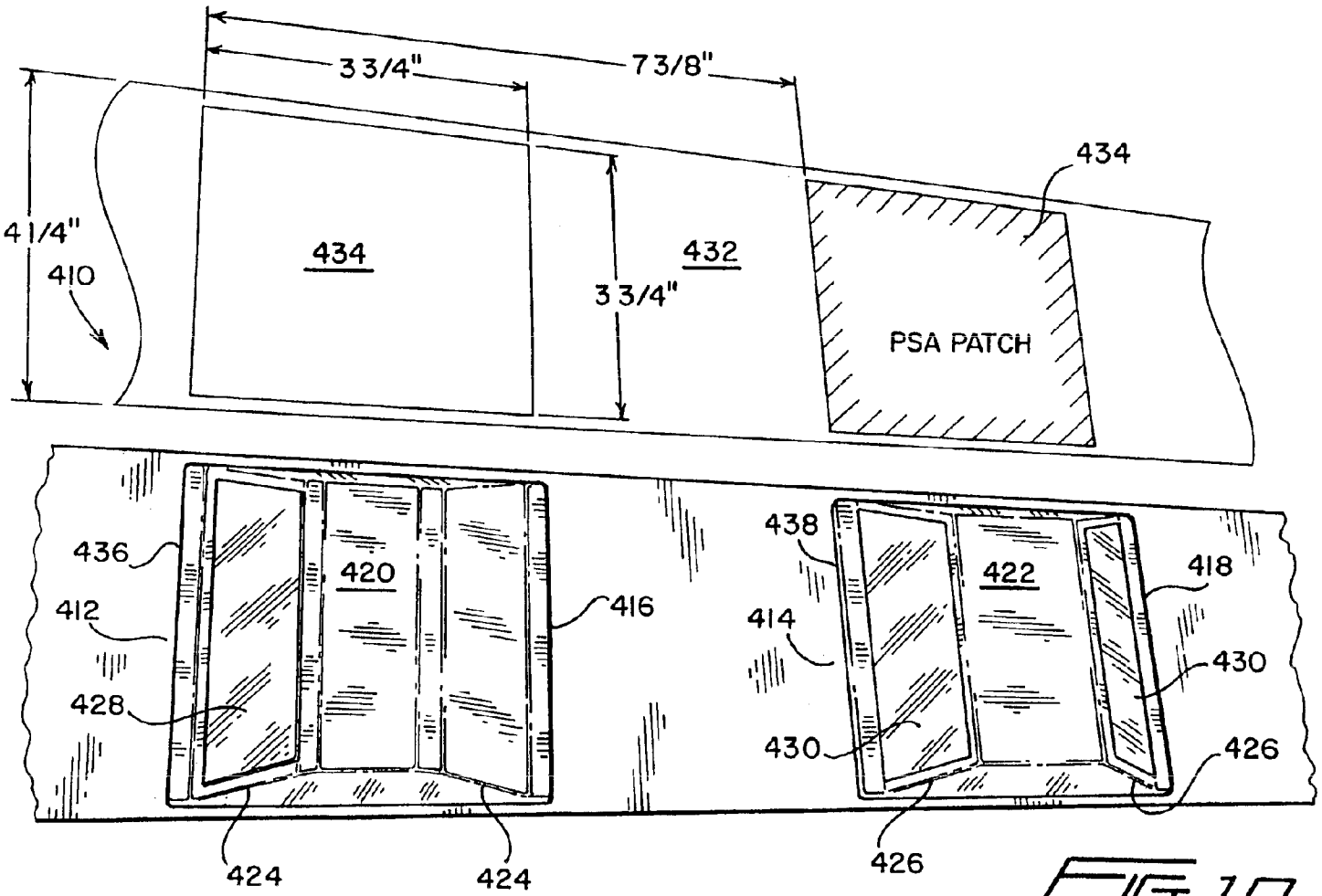
FIG. 10 is a top plan view, similar to that of FIG. 9, showing, however, two different embodiments of permanent full-track raised pavement markers (RPMs), having substantially trapezoidal cross-sectional configurations, that can be utilized in accordance with the principles and teachings of the present invention, and more particularly, the predetermined spaced disposition of the permanent full-track raised pavement markers (RPMs) with respect to each other when the permanent full-track raised pavement markers (RPMs) are adhesively bonded upon the release liner or release sheet.

While the principles and teachings of the present invention have been disclosed as being applicable in connection with permanent half-track raised pavement markers (RPMs), the principles and teachings of the present invention are equally applicable to different types of permanent full-track raised pavement markers (RPMs). With reference therefore being made to FIG. 10, a new and improved assembly of permanent full-track raised pavement markers (RPMs) is disclosed and is generally indicated by the reference character 410, it being noted that, as disclosed within FIG. 9, the permanent full-track raised pavement markers (RPMs) and the associated release sheet or release liner are shown prior to the actual adhesive bonding of the permanent raised pavement markers (RPMs) onto the release sheet or release liner and the subsequent fan-folding of the components into the aforenoted fan-folded collated array of permanent full-track raised pavement markers (RPMs). More particularly, it can be appreciated that the assembly of permanent full-track raised pavement markers (RPMs) 410 is seen to comprise first and second embodiments of permanent full-track raised pavement markers (RPMs) 412 and 414 wherein each one of the permanent raised pavement markers (RPMs) 412,414 respectively has a substantially square base section 416,418 and is known in the industry as a permanent full-track raised pavement marker (RPM) in that the external dimensions or footprint of each full-track permanent raised pavement marker (RPM) are approximately four inches (4.00") long and approximately four inches (4.00") wide.

It is to be appreciated further that the body section of the permanent full-track raised pavement markers (RPMs) 412, 414 respectively have substantially trapezoidal cross-sectional configurations comprising a substantially horizontally disposed upper section 420,422 and pairs of oppositely disposed inclined side wall sections 424,426. Suitably colored reflective elements 428,430, such as, for example, red or yellow, may be fixedly embedded within one or both of the inclined or sloped side wall sections 424,426 of each permanent full-track raised pavement marker (RPMs) 412, 414 such that when the permanent full-track raised pavement markers (RPMs) 412,414 are affixed to the roadway surface 230, the same may be readily seen or detected as a result of, for example, vehicle headlight beams illuminating the reflective elements 428,430. As was the case with the permanent half-track raised pavement markers (RPMs) 312, each one of the permanent full-track raised pavement markers (RPMs) 412,414 is adapted to have an adhesive pad or block member, not shown, fixedly secured to the undersurface portion thereof, the permanent half-track raised pavement marker 312, and in accordance with the principles and teachings of the present invention, and in a manner similar to that characteristic of the array of permanent half-track raised pavement markers (RPMs) 312 as disclosed within FIG. 9, the adhesive pads or block members of the plurality of permanent full-track raised pavement markers (RPMs) 412,414 are all removably disposed upon a single or common release sheet or release liner 432.

With reference continuing to be made to FIG. 10, it is noted that as was the case with the permanent half-track raised pavement markers (RPMs) 312 of the present invention as illustrated within FIG. 9, the plurality of permanent full-track raised pavement markers (RPMs) 412,414 are initially mounted upon the single or common release liner or release sheet 432 at predetermined locations spaced along the longitudinal extent of the release sheet or release liner 432 such that predetermined equal distances are defined between successive ones of the plurality of permanent full-track raised pavement markers (RPMs) 412,414. More particularly, as can best be appreciated from FIG. 10, each one of the plurality of permanent full-track raised pavement markers (RPMs) 412,414 is adapted to be secured upon the region 434 of the release sheet or release liner 432 entitled PSA PATCH, and it is seen that the permanent full-track raised pavement markers (RPMs) 412,414 are longitudinally spaced from each other, along the longitudinal extent of the release sheet or release liner 432, by means of a linear distance of approximately seven and three-eighth inches (7.375") as measured between respective edge portions 436,438 of each one of the plurality of permanent full-track raised pavement markers (RPMs) 412,414.

As was also the case with the collated array of permanent half-track raised pavement markers (RPMs) 312, it is noted that the lateral or widthwise extent of the release sheet or release liner 432 is greater than that of the PSA PATCH regions 434 such that the lateral ends of the adhesive pads or block members do not in fact extend beyond the lateral edges of the release sheet or release liner 434 in order to facilitate the packaging of the permanent full-track raised pavement markers (TRPMs) 412,414 within a suitable inclined box or container, not shown, in preparation for the serial dispensing and application of the permanent full-track raised pavement markers (TRPMs) 412,414 onto the roadway surface 230. As has been discussed in connection with the permanent half-track raised pavement markers (RPMs) 312, the disposition of the plurality of permanent full-track raised pavement markers (RPMs) 412,414 within the inclined conveyor box or container, not shown, permits the plurality of permanent full-track raised pavement markers (RPMs) 412, 414 to be collectively disposed along the aforenoted linear locus LL so as to likewise be capable of being dispensed onto the roadway surface 230 in a manner similar to that previously described in connection with the permanent half-track raised pavement markers (RPMs) 312.

It is also to be appreciated, as was the case with the packaging of the permanent half-track raised pavement markers (RPMs) 312 within the inclined box or container, not shown, that the structural arrangement defined between the release sheet or release liner 432 and the plurality of permanent full-track raised pavement markers (RPMs) 412, 414 permits the array of permanent full-track raised pavement markers (RPMs) 412,414 to be disposed within the box or container, not shown, without interference therebetween in view of the fact that the lateral side edge portions of the release sheet or release liner 432 will effectively be folded upwardly alongside the lateral side edge portions of each one of the plurality of permanent full-track raised pavement markers (RPMs) 412,414 so as to effectively cover the lateral side edge portions of each adhesive pad or block member, not shown, whereby such lateral side edge portions of the adhesive pads or block members, not shown, cannot adhere or become stuck to the interior side wall portions of the conveyor box or container, not shown. Still further, it is also to be noted that, in connection with the actual dispensing and application of the plurality of permanent full-track raised pavement markers (RPMs) 412,414 onto the roadway surface 230, the plurality of permanent full-track raised pavement markers (RPMs) 412,414 are adapted to be dispensed in a manner similar to that of the plurality of permanent half-track raised pavement markers (RPMs) 312 in that the bottom or undersurface portions of the same are disposed in immediate contact or engagement with the roadway surface 230, after being dispensed or discharged from the stripper plate 244, such that the applicator wheel 262 can immediately roll thereover.

Figure 12:
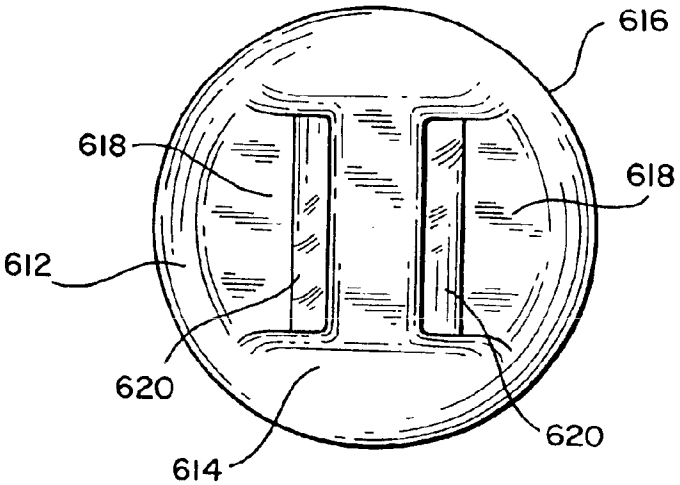
FIG. 12 is a top plan view of a fourth embodiment of a permanent full-track raised pavement marker (RPM) that can be utilized in accordance with the principles and teachings of the present invention, wherein the permanent full-track raised pavement marker (RPM) has a substantially circular, domed configuration with light reflective elements fixedly embedded upon diametrically opposite sides of the permanent full-track raised pavement marker (RPM)
Figure 13:
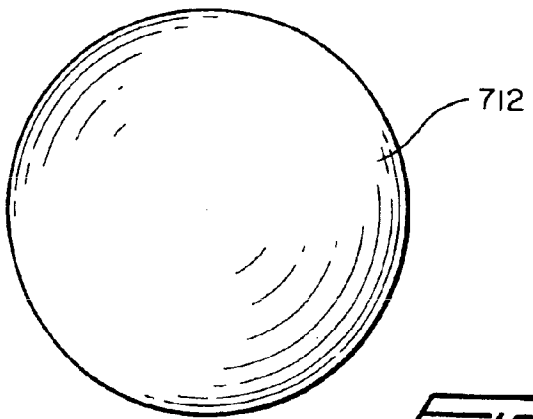
FIG. 13 is a top plan view of a fifth embodiment of a permanent full-track raised pavement marker (RPM) that can be utilized in accordance with the principles and teachings of the present invention, wherein the permanent full-track raised pavement marker (RPM) has a substantially elliptical, domed configuration, however, this permanent full-track raised pavement marker (RPM) is white in color such that no light reflective elements need be incorporated within this permanent full-track raised pavement marker (RPM).
Figure 11:
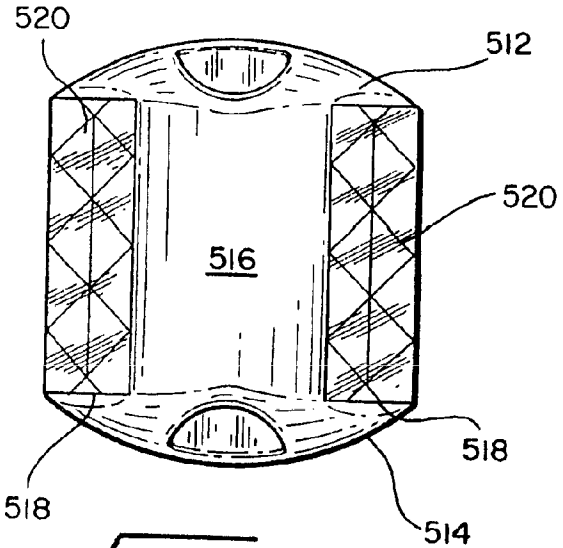
FIG. 11 is a top plan view of a third embodiment of a permanent full-track raised pavement marker (RPM) that can be utilized in accordance with the principles and teachings of the present invention, wherein the permanent full-track raised pavement marker (RPM) has a substantially elliptical, domed configuration with light reflective elements fixedly embedded upon diametrically opposite sides of the permanent full-track raised pavement marker (RPM)

With reference lastly being made to FIGS. 11–13, additional embodiments of permanent full-track raised pavement markers (RPMs) are respectively disclosed at 512, 612, and 712, and it is to be noted that all of these permanent full-track raised pavement markers (RPMs) 512,612,712 are adapted to be mounted upon release sheets or release liners, not shown, so as to form collated arrays of permanent full-track raised pavement markers (RPMs) which can also be dispensed and applied to the roadway surface 230 by means of the apparatus or system as disclosed within FIGS. 5–7. Briefly, it is seen, for example, that in connection with the third embodiment of a permanent full-track raised pavement marker (RPM) 512 as disclosed within FIG. 11, the base section 514 of the permanent full-track raised pavement marker 512 has a substantially elliptical configuration wherein the diametrical extent of the permanent full-track raised pavement marker 512, as taken along the major axis thereof, is approximately four inches (4.00"). The permanent full-track raised pavement marker 512 also has a substantially trapezoidal cross-sectional configuration comprising a raised upper surface 516 and a pair of oppositely disposed inclined side sections 518,518 upon which reflective elements 520,520 are respectively disposed.

As can be further appreciated from FIG. 12, the fourth embodiment of a permanent full-track raised pavement marker (RPM) 612 is seen to comprise a substantially domed body section 614 having a circular base section 616. The circular base section 616 has a footprint which encompasses a four inch (4.00") diametrical extent, and it is further seen that oppositely disposed interior or radially inner sections 618,618 of the domed body section 614 are recessed so as to respectively accommodate reflective elements 620, 620. Lastly, as can be appreciated from FIG. 13, the fifth embodiment of a permanent full-track raised pavement marker (RPM) 712 is seen to be similar to the fourth embodiment permanent full-track raised pavement marker (RPM) 612 in that the same comprises a substantially domed body section 714 having a circular base section 716 which also has a footprint which encompasses a four inch (4.00") diametrical extent. However, in lieu of the permanent full-track raised pavement marker (RPM) 712 being provided with reflective elements, as disclosed at 620,620 in connection with the permanent full-track raised pavement marker (RPM) 612, the permanent full-track raised pavement marker (RPM) 712 is devoid of reflective elements, and instead, is colored white so as to also facilitate being readily seen or visible during nighttime hours as a result of the reflection thereon of automotive headlight beams.

Thus, it may be seen that in accordance with the principles and teachings of the present invention, there has been provided a new and improved collated or nested array of temporary raised pavement markers (TRPMs) and permanent half-track and full-track raised pavement markers (RPMs) wherein the plurality of temporary raised pavement markers (TRPMs) and permanent half-track and full-track raised pavement markers (RPMs) are fixedly secured upon a release sheet or release liner at predetermined, longitudinally spaced locations along the release sheet or release liner, and wherein, in accordance with a unique and novel feature characteristic of the present invention, the release sheet or release liner is fan-folded between the successively stacked or nested temporary raised pavement markers (TRPMs), or permanent half-track and full-track raised pavement markers (RPMs), in such a manner that the rearwardly disposed or oriented folds or loops of the release sheet or release liner are disposed beneath each associated one of the adhesive pad or block members of the respective temporary raised pavement markers (TRPMs), or permanent half-track and full-track raised pavement markers (RPMs), at a position just forward of the rear edge portion of the adhesive pad or block member. In this manner, when the release sheet or release liner is to be peeled or stripped from each successive temporary raised pavement marker (TRPM), or permanent half-track and full-track raised pavement marker (RPM), the release sheet or release liner is effectively unfolded so as to effectively cause the feather-edge bond boundary to be recombined with the primary mass of the adhesive pad or block member and thereby be assimilated thereby. Accordingly, the peeling or stripping of the release sheet or release liner from the plurality of temporary raised pavement markers (TRPMs), or from the plurality of permanent half-track and full-track raised pavement markers (RPMs), is able to be achieved without encountering the difficulties previously characteristic of PRIOR ART raised pavement markers (RPMs).

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A method of forming a nested collated array of permanent raised pavement markers (RPMs), comprising the steps of:

providing a plurality of permanent raised pavement markers (RPMs), wherein each one of said plurality of permanent raised pavement markers (RPMs) has an upper surface portion and a bottom surface portion;

providing adhesive means for disposition upon said bottom surface portion of each one of said plurality of permanent raised pavement markers (RPMs) so as to permit each one of said bottom surface portions of said plurality of permanent raised pavement markers (RPMs) to be fixedly adhered to a pavement surface as a result of said plurality of permanent raised pavement markers (RPMs) being serially dispensed and said bottom surface portions of said plurality of permanent raised pavement markers (RPMs) being respectively applied to the pavement surface at predeterminedly spaced positions located along the pavement surface;

providing a single release sheet, to which all of said adhesive means of said plurality of permanent raised pavement markers (RPMs) are separably adhered prior to the serial dispensing and application of said plurality of permanent raised pavement markers (RPMs) onto the pavement surface, so as to effectively define, along with said plurality of permanent raised pavement markers (RPMs), said collated array of said plurality of permanent raised pavement markers (RPMs) to be dispensed and applied onto the pavement surface; and forming said collated array of said plurality of permanent raised pavement markers (RPMs) into a nested collated array of permanent raised pavement markers (RPMs) by disposing successive ones of said plurality of permanent raised pavement markers (RPMs) in a nested array wherein an undersurface portion of one of said plurality of permanent raised pavement markers (RPMs) is disposed in contact with an upper surface portion of a successive one of said plurality of permanent raised pavement markers (RPMs).

2. The method of forming a collated array of permanent raised pavement markers (RPMs) as set forth in claim 1, further comprising the steps of:

disposing said plurality of permanent raised pavement markers (RPMs) within said nested array with respect to each other prior to the serial dispensing and application of said plurality of permanent raised pavement markers (RPMs) onto the pavement surface.

3. The method of forming a collated array of permanent raised pavement markers (RPMs) as set forth in claim 2, further comprising the steps of:

disposing said plurality of permanent raised pavement markers (RPMs) atop one another when said plurality of permanent raised pavement markers (RPMs) are disposed within said nested array; and interposing portions of said single release sheet, to which all of said adhesive means of said plurality of permanent raised pavement markers (RPMs) are adhered prior to the serial dispensing and application of said plurality of permanent raised pavement markers (RPMs) onto the pavement surface, between successive ones of said plurality of nested permanent raised pavement markers (RPMs).

4. The method of forming a collated array of permanent raised pavement markers (RPMs) as set forth in claim 3, further comprising the step of:

forming each one of said portions of said single release sheet, interposed between said successive ones of said plurality of nested permanent raised pavement markers (RPMs), into a folded loop, set inwardly with respect to an edge portion of each one of said adhesive means, such that when each one of said folded loops is unfolded in connection with the serial dispensing and application of said permanent raised pavement markers (RPMs) onto the pavement surface, a feather-edge bond structure, defined at a boundary region between each folded loop portion of said release sheet and each one of said adhesive means, is able to be effectively recombined with a respective one of said adhesive means so as to effectively permit said feather-edge bond structure to be completely assimilated within said adhesive means and thereby readily permit the easy separation, peeling, and stripping of said release sheet from each one of said adhesive means.

5. The method of forming a collated array of permanent raised pavement markers (RPMs) as set forth in claim 3, further comprising the steps of:

providing each one of said plurality of permanent raised pavement markers (RPMs) with a predetermined lateral width dimension; and providing said single release sheet with a predetermined lateral width dimension which is greater than said predetermined lateral width dimension of each one of said plurality of permanent raised pavement markers (RPMs) such that side edge portions of said single release sheet extend beyond side edge portions of each one of said plurality of permanent raised pavement markers (RPMs).

6. The method of forming a collated array of permanent raised pavement markers (RPMs) as set forth in claim 3, further comprising the step of:

forming each one of said portions of said single release sheet, interposed between said successive ones of said plurality of nested permanent raised pavement markers (RPMs), into a folded loop so as to be routed beneath said bottom surface portion of one of said plurality of nested permanent raised pavement markers (RPMs) and over said upper surface portion of a successive one of said plurality of nested permanent raised pavement markers (RPMs).

7. A method of forming a nested collated array of permanent raised pavement markers (RPMs), comprising the steps of:

providing a plurality of permanent raised pavement markers (RPMs), wherein each one of said plurality of permanent raised pavement markers (RPMs) has an upper surface portion and a bottom surface portion;

providing adhesive means upon said bottom surface portion of each one of said plurality of permanent raised pavement markers (RPMs) so as to permit each one of said bottom surface portions of said plurality of permanent raised pavement markers (RPMs) to be fixedly adhered to a pavement surface as a result of said plurality of permanent raised pavement markers (RPMs) being serially dispensed and said bottom surface portions of said plurality of permanent raised pavement markers (RPMs) being respectively applied to the pavement surface at predeterminedly spaced positions located along the pavement surface;

providing a single release sheet, to which all of said adhesive means of said plurality of permanent raised pavement markers (RPMs) are separably adhered prior to the serial dispensing and application of said plurality of permanent raised pavement markers (RPMs) onto the pavement surface, so as to effectively define, along with said plurality of permanent raised pavement markers (RPMs), said collated array of said plurality of permanent raised pavement markers (RPMs) to be dispensed and applied onto the pavement surface; and forming said collated array of said plurality of permanent raised pavement markers (RPMs) into a nested collated array of permanent raised pavement markers (RPMs) by disposing successive ones of said plurality of permanent raised pavement markers (RPMs) in a nested array wherein an undersurface portion of one of said plurality of permanent raised pavement markers (RPMs) is disposed in contact with an upper surface portion of a successive one of said plurality of permanent raised pavement markers (RPMs).

8. The method of forming a collated array of permanent raised pavement markers (RPMs) as set forth in claim 7, further comprising the steps of:

disposing said plurality of permanent raised pavement markers (RPMs) within said nested array with respect to each other prior to the serial dispensing and application of said plurality of permanent raised pavement markers (RPMs) onto the pavement surface.

9. The method of forming a collated array of permanent raised pavement markers (RPMs) as set forth in claim 8, further comprising the steps of:

disposing said plurality of permanent raised pavement markers (RPMs) atop one another when said plurality of permanent raised pavement markers (RPMs) are disposed within said nested array; and interposing portions of said single release sheet, to which all of said adhesive means of said plurality of permanent raised pavement markers (RPMs) are adhered prior to the serial dispensing and application of said plurality of permanent raised pavement markers (RPMs) onto the pavement surface, between successive ones of said plurality of nested permanent raised pavement markers (RPMs).

10. The method of forming a collated array of permanent raised pavement markers (RPMs) as set forth in claim 9, further comprising the step of:

forming each one of said portions of said single release sheet, interposed between said successive ones of said plurality of nested permanent raised pavement markers (RPMs), into a folded loop, set inwardly with respect to an edge portion of each one of said adhesive means, such that when each one of said folded loops is unfolded in connection with the serial dispensing and application of said permanent raised pavement markers (RPMs) onto the pavement surface, a feather-edge bond structure, defined at a boundary region between each folded loop portion of said release sheet and each one of said adhesive means, is able to be effectively recombined with a respective one of said adhesive means so as to effectively permit said feather-edge bond structure to be completely assimilated within said adhesive means and thereby readily permit the easy separation, peeling, and stripping of said release sheet from each one of said adhesive means.

11. The method of forming a collated array of permanent raised pavement markers (RPMs) as set forth in claim 9, further comprising the steps of:

providing each one of said plurality of permanent raised pavement markers (RPMs) with a predetermined lateral width dimension; and providing said single release sheet with a predetermined lateral width dimension which is greater than said predetermined lateral width dimension of each one of said plurality of permanent raised pavement markers (RPMs) such that side edge portions of said single release sheet extend beyond side edge portions of each one of said plurality of permanent raised pavement, markers (RPMs).

12. The method of forming a collated array of permanent raised pavement markers (RPMs) as set forth in claim 9, further comprising the step of:

forming each one of said portions of said single release sheet, interposed between said successive ones of said plurality of nested permanent raised pavement markers (RPMs), into a folded loop so as to be routed beneath said bottom surface portion of one of said plurality of nested permanent raised pavement markers (RPMs) and over said upper surface portion of a successive one of said plurality of nested permanent raised pavement markers (RPMs).

13. A method of forming a nested collated array of permanent raised pavement markers (RPMs), comprising the steps of:

providing a plurality of permanent raised pavement markers (RPMs), wherein each one of said plurality of permanent raised pavement markers has an upper surface portion and a bottom surface portion;

providing a single release sheet, to which said plurality of permanent raised pavement markers (RPMs) are separably affixed, so as to effectively define, along with said plurality of permanent raised pavement markers (RPMs), a collated array of said plurality of permanent raised pavement markers (RPMs) which are to be serially dispensed and applied onto a pavement surface;

separably mounting adhesive means upon said single release sheet, at predeterminedly spaced positions defined along said single release sheet, for being adhesively bonded to said bottom surface portion of each one of said plurality of permanent raised pavement markers (RPMs) prior to the serial dispensing and application of said plurality of permanent raised pavement markers (RPMs) onto the pavement surface such that each one of said bottom surface portions of said plurality of permanent raised pavement markers (RPMs) can be fixedly adhered to the pavement surface as a result of said plurality of permanent raised pavement markers (RPMs) being serially dispensed and said bottom surface portions of said plurality of permanent raised pavement markers (RPMs) being respectively applied to the pavement surface at predeterminedly spaced positions located along the pavement surface; and forming said collated array of said plurality of permanent raised pavement markers (RPMs) into a nested collated array of permanent raised pavement markers (RPMs) by disposing successive ones of said plurality of permanent raised pavement markers (RPMs) in a nested array wherein an undersurface portion of one of said plurality of permanent raised pavement markers (RPMs) is disposed in contact with an upper surface portion of a successive one of said plurality of permanent raised pavement markers (RPMs).

14. The method of forming a collated array of permanent raised pavement markers (RPMs) as set forth in claim 13, further comprising the steps of:

disposing said plurality of permanent raised pavement markers (RPMs) within said nested array with respect to each other prior to the serial dispensing and application of said plurality of permanent raised pavement markers (RPMs) onto the pavement surface.

15. The method of forming a collated array of permanent raised pavement markers (RPMs) as set forth in claim 14, further comprising the steps of:

disposing said plurality of permanent raised pavement markers (RPMs) atop one another when said plurality of permanent raised pavement markers (RPMs) are disposed within said nested array; and interposing portions of said single release sheet, to which all of said adhesive means of said plurality of permanent raised pavement markers (RPMs) are adhered prior to the serial dispensing and application of said plurality of permanent raised pavement markers (RPMs) onto the pavement surface, between successive ones of said plurality of nested permanent raised pavement markers (RPMs).

16. The method of forming a collated array of permanent raised pavement markers (RPMs) as set forth in claim 15, further comprising the step of:

forming each one of said portions of said single release sheet, interposed between said successive ones of said plurality of nested permanent raised pavement markers (RPMs), into a folded loop, set inwardly with respect to an edge portion of each one of said adhesive means, such that when each one of said folded loops is unfolded in connection with the serial dispensing and application of said permanent raised pavement markers (RPMs) onto the pavement surface, a feather-edge bond structure, defined at a boundary region between each folded loop portion of said release sheet and each one of said adhesive means, is able to be effectively recombined with a respective one of said adhesive means so as to effectively permit said feather-edge bond structure to be completely assimilated within said adhesive means and thereby readily permit the easy separation, peeling, and stripping of said release sheet from each one of said adhesive means.

17. The method of forming a collated array of permanent raised pavement markers (RPMs) as set forth in claim 15, further comprising the steps of:

providing each one of said plurality of permanent raised pavement markers (RPMs) with a predetermined lateral width dimension; and providing said single release sheet with a predetermined lateral width dimension which is greater than said predetermined lateral width dimension of each one of said plurality of permanent raised pavement markers (RPMs) such that side edge portions of said single release sheet extend beyond side edge portions of each one of said plurality of permanent raised pavement markers (RPMs).

18. The method of forming a collated array of permanent raised pavement markers (RPMs) as set forth in claim 15, further comprising the step of:

forming each one of said portions of said single release sheet, interposed between said successive ones of said plurality of nested permanent raised pavement markers (RPMs), into a folded loop so as to be routed beneath said bottom surface portion of one of said plurality of nested permanent raised pavement markers (RPMs) and over said upper surface portion of a successive one of said plurality of nested permanent raised pavement markers (RPMs).

* * * * *